US007328160B2

(12) United States Patent
Nishio et al.

(10) Patent No.: US 7,328,160 B2
(45) Date of Patent: Feb. 5, 2008

(54) ENCODING DEVICE AND DECODING DEVICE

(75) Inventors: Kosuke Nishio, Moriguchi (JP); Takeshi Norimatsu, Kobe (JP); Mineo Tsushima, Katano (JP); Naoya Tanaka, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 974 days.

(21) Appl. No.: 10/285,633

(22) Filed: Nov. 1, 2002

(65) Prior Publication Data

US 2003/0088423 A1 May 8, 2003

(30) Foreign Application Priority Data

Nov. 2, 2001 (JP) ..... 2001-337869
Nov. 30, 2001 (JP) ..... 2001-367008
Dec. 14, 2001 (JP) ..... 2001-381807

(51) Int. Cl.
*G10L 19/00* (2006.01)

(52) U.S. Cl. ..... 704/500; 704/203; 704/205; 704/501

(58) Field of Classification Search ..... 704/203, 704/205, 500, 501
See application file for complete search history.

(56) References Cited

U.S. PATENT DOCUMENTS 5,522,009 A 5/1996 Laurent
5,546,477 A * 8/1996 Knowles et al. ..... 382/242
5,592,584 A 1/1997 Ferreira et al.
5,684,920 A * 11/1997 Iwakami et al. ..... 704/203

(Continued)

FOREIGN PATENT DOCUMENTS

JP 06-027998 2/1994

(Continued)

OTHER PUBLICATIONS

ISO/IEC JTC1/SC29/WG11 IS 13818-7, "Information technology—Generic coding of moving pictures and associated audio information", Part 7: Advanced Audio Coding (AAC), First edition Dec. 1, 1997.

(Continued)

*Primary Examiner*—Richemond Dorvil
*Assistant Examiner*—Leonard Saint-Cyr
(74) *Attorney, Agent, or Firm*—Wenderoth, Lind & Ponack, L.L.P.

(57) ABSTRACT

An encoding device includes a transforming unit operable to extract a part of an inputted audio signal at predetermined time intervals and to transform each extracted part to produce a plurality of windows composed of short blocks, and a judging unit operable to compare the windows with one another to judge whether there is a similarity of a predetermined degree and to replace a high frequency part of a first window, which is one of the produced windows, with values "0" when there is the similarity, wherein the first window and a second window share a high frequency part of the second window, which is also one of the produced windows. The encoding device also includes a first quantizing unit operable to quantize the produced windows after replacing operation; a first encoding unit operable to encode the quantized windows to produce encoded data; and a stream output unit operable to output the produced encoded data.

33 Claims, 17 Drawing Sheets

U.S. PATENT DOCUMENTS

| | | | | |
|---|---|---|---|---|
| 5,737,718 | A * | 4/1998 | Tsutsui | 704/205 |
| 5,867,819 | A * | 2/1999 | Fukuchi et al. | 704/500 |
| 6,356,639 | B1 | 3/2002 | Ishito et al. | |
| 6,680,972 | B1 * | 1/2004 | Liljeryd et al. | 375/240 |
| 6,711,538 | B1 | 3/2004 | Omori et al. | |
| 6,823,310 | B2 | 11/2004 | Ishito et al. | |
| 2002/0035407 | A1 | 3/2002 | Ishito et al. | |

FOREIGN PATENT DOCUMENTS

| | | |
|---|---|---|
| JP | 10-340099 | 12/1998 |
| JP | 2000-137497 | 5/2000 |
| JP | 2001-100773 | 4/2001 |
| JP | 2001-154698 | 6/2001 |
| JP | 2001-166800 | 6/2001 |
| JP | 2001-188563 | 7/2001 |
| JP | 2001-296893 | 10/2001 |
| WO | 98/57436 | 12/1998 |
| WO | 00/45379 | 8/2000 |

OTHER PUBLICATIONS

Co-pending U.S. Appl. No. 10/285,609, filed Nov. 1, 2002, entitled "*Encoding Device and Decoding Device*".

Co-pending U.S. Appl. No. 10/285,627, filed Nov. 1, 2002, entitled "*Decoding Device, Decoding Device and Audio Data Distribution System*".

Co-pending U.S. Appl. No. 10/140,881, filed May 9, 2002, entitled "*Encoding Device, Decoding Device, and Broadcast System*".

Alan McCree, "*A 14 KB/S Wideband Speech Coder With A Parametric Highband Model*", DSP Solutions R&D Center, Texas Instruments, Dallas, Texas (2000), pp. 1153-1156.

* cited by examiner

Fig. 5A
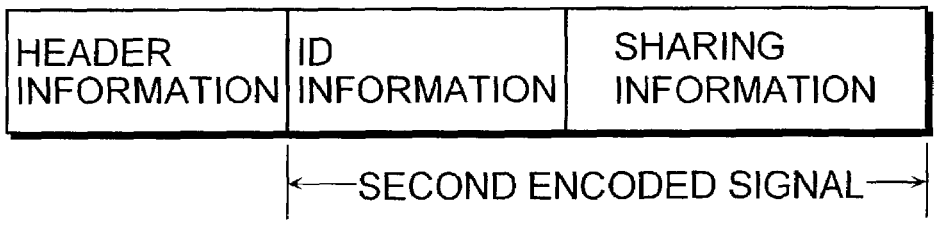
Fig. 5B
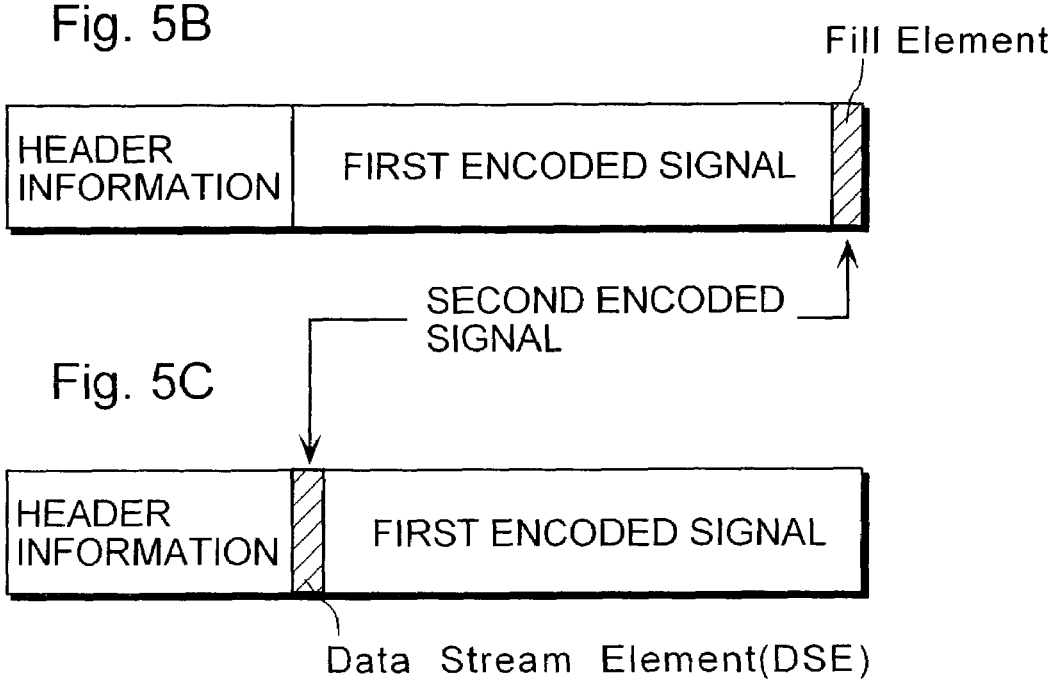
Fig. 5C

Fig. 16

500

| | CONVENTIONAL ENCODING DEVICE 300 | ENCODING DEVICE 102 OF THE INVENTION |
|---|---|---|
| 501 (TRANSFORMING UNIT) SPECTRAL DATA | 10 , 40 , 100 , 30 | 10 , 40 , 100 , 30 |
| 502 (FIRST QUANTIZING UNIT) QUANTIZED DATA | 0 , 0 , 1 , 0 | 0 , 0 , 1 , 0 |
| 503 (SECOND QUANTIZING UNIT) QUANTIZED DATA | | 1 , 4 , 10 , 3 |
| 504 QUANTIZED DATA IN SECOND ENCODED SIGNAL | | 1 , 2 , 0 , 2 |
| 505 RECONSTRUCTED SPECTRAL DATA | 0 , 0 , 100 , 0 | 20 , 40 , 100 , 40 |

ENCODING DEVICE AND DECODING DEVICE

TECHNICAL FIELD

The present invention relates to technology for encoding and decoding digital audio data.

BACKGROUND ART

In recent years, a variety of audio compression methods have been developed. MPEG-2 Advanced Audio Coding (MPEG-2 AAC) is one of such compression methods, and is defined in detail in "ISO/IEC 13818-7 (MPEG-2 Advanced Audio Coding, AAC)".

The following describes conventional encoding and decoding procedures with reference to FIG. 1. FIG. 1 is a block diagram showing a conventional encoding device 300 and a conventional decoding device 400 conforming to MPEG-2 AAC. The encoding device 300 receives and encodes an audio signal in accordance with MPEG-2 AAC, and comprises an audio signal input unit 310, a transforming unit 320, a quantizing unit 331, an encoding unit 332, and a stream output unit 340.

The audio signal input unit 310 receives digital audio data that has been generated as a result of sampling at a 44.1-kHz sampling frequency. From this digital audio data, the audio signal input unit 310 extracts 1,024 consecutive samples. Such 1,024 samples are a unit of encoding and are called a frame.

The transforming unit 320 transforms the extracted samples (hereafter called "sampled data") in the time domain into spectral data composed of 1,024 samples in the frequency domain in accordance with Modified Discrete Cosine Transform (MDCT). This spectral data is then divided into a plurality of groups, each of which contains at least one sample and simulates a critical band of human hearing. Each such group is called a "scale factor band".

The quantizing unit 331 receives the spectral data from the transforming unit 320, and quantizes it with a normalizing factor corresponding to each scale factor band. This normalizing factor is called a "scale factor", and each set of spectral data quantized with the scale factor is hereafter called "quantized data".

In accordance with Huffman coding, the encoding unit 332 encodes the quantized data and each scale factor used for the quantized data. Before encoding scale factors, the encoding unit 332 specifies, for every scale factor, a difference in values of two scale factors in two consecutive scale factor bands. The encoding unit 332 then encodes each specified difference and a scale factor used in a scale factor band at the start of the frame.

The stream output unit 340 receives the encoded signal from the encoding unit 332, transforms it into an MPEG-2 AAC bit stream and outputs it. This bit stream is either transmitted to the decoding device 400 via a transmission medium, or recorded on a recording medium, such as an optical disc including a compact disc (CD) and a digital versatile disc (DVD), a semiconductor, and a hard disk.

The decoding device 400 decodes this bit stream encoded by the encoding device 300, and includes a stream input unit 410, a decoding unit 421, a dequantizing unit 422, an inverse-transforming unit 430, and an audio signal output unit 440.

The stream input unit 410 receives the MPEG-2 AAC bit stream encoded by the encoding device 300 via a transmission medium, or reconstructs the bit stream from a recording medium. The stream input unit 410 then extracts the encoded signal from the bit stream.

The decoding unit 421 decodes the extracted encoded signal that has the format for the stream so that quantized data is produced.

The dequantizing unit 422 dequantizes the quantized data (which is Huffman-encoded when MPEG-2 AAC is used) to produce spectral data in the frequency domain.

The inverse-transforming unit 430 transforms the spectral data into the sampled data in the time domain. For MPEG-2 AAC, this conversion is performed based on Inverse Modified Discrete Cosine Transform (IMDCT).

The audio signal output unit 440 combines sets of sampled data outputted from the inverse-transforming unit 430, and outputs it as digital audio data.

In MPEG-2 AAC, the length of the sampled data subject to MDCT conversion can be changed in accordance with an inputted audio signal. When sampled data for which MDCT is to be performed is composed of 256 samples, this sampled data is based on short blocks. When sampled data for which MDCT is to be performed is composed of 2,048 samples, the sampled data is based on long blocks. The short and long blocks represent a block size.

When digital audio data is sampled at the 44.1-kHz sampling frequency and a short block is applied, the encoding device 300 extracts, from the sampled audio data, 128 samples together with two sets of 64 samples obtained immediately before and after the 128 samples, that is, 256 samples in total. These two sets of 64 samples overlap with other two sets of 128 samples that are extracted immediately before and after the present 128 samples. The extracted audio data is transformed based on MDCT into spectral data composed of 256 samples, out of which only half, that is, 128 samples are quantized and encoded. Eight consecutive windows that each include spectral data composed of 128 samples are regarded as a frame composed of 1,024 samples, and this frame is a unit subject to the subsequent processing including quantizing and encoding.

In this way, a window based on a short block includes 128 samples while a window based on a long block includes 1,024 samples. When audio data of a 22.05-kHz reproduction band represented by short blocks is compared with the same audio data represented by long blocks, audio data represented by short blocks has a better time resolution even for an audio signal based on short cycles, although audio data represented by long blocks achieves better sound quality because more samples are used to represent the same audio data. That is to say, if an extracted audio signal within a window contains an attack (a high-amplitude spike pulse), its damage is more extensive in long blocks than in short blocks because the attack affects as many as 1,024 samples within a window based on long bocks. With the short blocks, however, damage of the attack is confined within one window composed of 128 samples and spectrums in other windows are not susceptible to the attack, which allows more accurate reproduction of original sound.

The quality of audio data encoded by the encoding device 300 and sent to the decoding device 400 can be measured, for instance, by a reproduction band of the encoded audio data. When an input signal is sampled at the 44.1-kHz sampling frequency, for instance, a reproduction band of this signal is 22.05 kHz. When the audio signal with the 22.05-kHz reproduction band or wider reproduction band close to 22.05 kHz is encoded into encoded audio data without degradation, and all the encoded audio data is transmitted to the decoding device, then this audio data can be reproduced as high-quality sound. The width of a reproduction band, however, affects the number of values of spectral data, which in turn affects the amount of data for transmission. For instance, when an input audio signal is sampled at the sampling frequency of 44.1 kHz, spectral data generated from this signal is composed of 1,024 samples, which has the 22.05-kHz reproduction band. In order to secure the 22.05-kHz reproduction band, all the 1,024 samples of the spectral data needs to be transmitted. This requires efficient encoding of an audio signal so as to restrict a bit amount of the encoded audio signal to a range of a transfer rate of a transmission channel.

It is not realistic to transmit as many as 1,024 samples of the spectral data via a low-rate transmission channel of, for instance, a portable phone. This is to say, when all the spectral data with a wide reproduction band is transmitted at such low transfer rate while the bit amount of the entire spectral data is adjusted for the low transfer rate, amounts of bits of data assigned to each frequency band becomes extremely small. This intensifies the effect of quantization noise, so that sound quality decreases after encoding.

In order to prevent such degradation, efficient audio signal transmission is achieved in many of audio signal encoding methods, including MPEG-2 AAC, according to which appropriate weights are assigned to each set of the spectral data, and low-weighted values are not transmitted. With this method, a sufficient bit amount is assigned to spectral data in a low frequency band, which is important for human hearing, to enhance its encoding accuracy, while spectral data in a high frequency band is regarded as less important and is often not transmitted.

Although such techniques are used in MPEG-2 AAC, audio encoding technology that achieves reproduction at higher quality and higher compression efficiency is now required. In other words, there is an increasing demand for technology of transmitting an audio signal in both high and low frequency bands at a low transfer rate.

SUMMARY OF INVENTION

In view of the above problems, the encoding device of the present invention receives and encodes an audio signal, and includes: a transforming unit operable to extract a part of the received audio signal at predetermined time intervals and to transform each extracted part to produce a plurality of window spectrums in each frame cycle, wherein the produced window spectrums are composed of short blocks and show how a frequency spectrum changes over time; a judging unit operable to compare the window spectrums with one another to judge whether there is a similarity of a predetermined degree among the compared window spectrums; a replacing unit operable to replace a high frequency part of a first window spectrum, which is one of the produced window spectrums, with a predetermined value when the judging unit judges that there is the similarity, wherein the first window spectrum and a second window spectrum share a high frequency part of the second window spectrum, which is also one of the produced window spectrums; a first quantizing unit operable to quantize the plurality of window spectrums to produce a plurality of quantized window spectrums after operation of the replacing unit; a first encoding unit operable to encode the quantized window spectrums to produce first encoded data; and an output unit operable to output the produced first encoded data.

With the above plurality of window spectrums composed of short blocks produced by the transforming unit in each frame cycle, adjacent window spectrums are likely to be similar to one another. When the judging unit judges that there is a similarity between the first and second window spectrums, a high frequency part of the first window spectrum is not quantized and encoded. Instead, this high frequency part is represented by a high frequency part of the second window spectrum. In more detail, the high frequency part of the first window spectrum is replaced with predetermined values. When values "0", for instance, are used as the predetermined values, quantizing and encoding operations for this high frequency part are simplified. In addition, the bit amount of the high frequency part can be highly reduced.

A decoding device, which can be used with the above encoding device, receives and decodes encoded data that represents an audio signal. This encoded data includes first encoded data in a first region. The decoding device includes: a first decoding unit operable to decode the first encoded data in the first region to produce first decoded data; a first dequantizing unit operable to dequantize the first decoded data to produce a plurality of window spectrums in each frame cycle, wherein the produced window spectrums are composed of short blocks and show how a frequency spectrum changes over time; a judging unit operable to (a) monitor the produced window spectrums so as to find a first window spectrum whose high frequency part is composed of predetermined values and (b) judge that the high frequency part of the first window spectrum is to be recreated from a high frequency part of a second window spectrum included in the plurality of window spectrums; a second dequantizing unit operable to (a) obtain the high frequency part of the second window spectrum from the first dequantizing unit, (b) duplicate the obtained high frequency part, (c) associate the duplicated high frequency part with the first window spectrum, and (d) output the duplicated high frequency part; and an audio signal output unit operable to (a) obtain the duplicated high frequency part from the second dequantizing unit, and the first window spectrum from the first dequantizing unit, (b) replace the high frequency part of the first window spectrum with the duplicated high frequency part, (c) transform the first window spectrum containing the replaced high frequency part into an audio signal in a time domain, and (d) output the audio signal.

The above decoding device receives at least one high frequency part of a window spectrum in each frame cycle, duplicates the high frequency part in accordance with the judgment by the judging unit, and uses the duplicated high frequency part as a high frequency part of other window spectrums. As a result, the present decoding device is capable of reproducing sound in the high frequency band at higher quality than a conventional decoding device.

Here, when the judging unit of the encoding device judges that there is the similarity, the replacing unit may also replace a low frequency part of the first window spectrum with a predetermined value.

When different window spectrums are similar to one another to the predetermined degree, the above encoding device replaces not only the high frequency part, but also the low frequency part of one of the window spectrums with a predetermined value. When the predetermined value is "0", for instance, quantizing and encoding operations for the replaced parts are simplified. In addition, the bit amount of resulting encoded data can be highly reduced by the bit amount of the lower frequency part as well as the higher frequency part replaced with the values "0".

The decoding device used with the above encoding device may be as follows. When finding a window spectrum composed of sets of data that has a predetermined value, the judging unit may judge that the high frequency part of the found window spectrum is to be recreated from the high frequency part of the second window spectrum. In accordance with the judgment result by the judging unit, the second dequantizing unit may obtain the whole second window spectrum, including both high and low frequency parts, from the first dequantizing unit, duplicate the obtained second window spectrum, associate the duplicated second window spectrum with the found window spectrum, and output the duplicated second window spectrum. The audio signal output unit may replace the entire found window spectrum with the duplicated second window spectrum, transform the replaced window spectrum into an audio signal in the time domain, and output the audio signal.

In each frame cycle, the above decoding device receives at least one window spectrum, including both high and low frequency parts, and duplicates the received window spectrum in accordance with the judgment result by the judging unit so as to reconstruct other window spectrums. From the received high frequency part, the present decoding device is capable of reproducing sound that has higher quality in the high frequency band than a conventional decoding device, although a certain error may be caused in the low frequency part according to the predetermined criteria used for the judgment by the judging unit.

For the above encoding device, each of the plurality of window spectrums may be composed of sets of data. The encoding device may further comprise: a second quantizing unit operable to quantize, with a predetermined normalizing factor, certain sets of data near a peak in each window spectrum inputted to the first quantizing unit, wherein before quantization by the second quantizing unit, the first quantizing unit quantizes the certain sets of data to produce sets of quantized data that have a predetermined value; and a second encoding unit operable to encode the sets of quantized data to produce second encoded data. The output unit may output the second encoded data as well as the first encoded data.

When the above first quantizing unit produces, from certain sets of data near a peak in a window spectrum, sets of quantized data that have the same predetermined value, the second quantizing unit quantizes the certain sets of data by using a predetermined normalizing factor. As a result, the second quantizing unit produces sets of quantized data whose values are not consecutively the same predetermined value. That is to say, quantization by the second quantizing unit can correct an error caused in sets of spectral data near a peak in a window spectrum.

Here, the decoding device used with the above encoding device may be as follows. The encoded data received by the decoding device also includes second encoded data, which has been produced by quantizing a part of a window spectrum with a predetermined normalizing factor that is different from a normalizing factor used for quantizing the same window spectrum in the first encoded data. The decoding device may further include: a second separating unit operable to separate the second encoded data from a second region of the received encoded data; and a second decoding unit operable to decode the separated second encoded data to obtain second decoded data. The second dequantizing unit may also (a) monitor the plurality of window spectrums produced by the first dequantizing unit so as to find a part, which consecutively contains predetermined values, of a window spectrum, (b) specify a part that corresponds to the found part and that is included in the second decoded data, and (c) dequantize the specified part by using the predetermined normalizing factor to obtain a dequantized part composed of a plurality of sets of data. The audio signal output unit may also (a) replace the part found by the second dequantizing unit with the plurality of sets of data, (b) transform the window spectrum containing the sets of spectral data into an audio signal in the time domain, and (c) output the audio signal.

When the first quantizing unit of the encoding device produces, from certain sets of data near a peak in a window spectrum, sets of quantized data that have the same predetermined value, the second dequantizing unit of the decoding device roughly reconstructs the certain sets of data. That is to say, the second dequantizing unit corrects an error caused in sets of spectral data near a peak of a window spectrum. Consequently, the present decoding device is capable of reproducing sound near a peak of a window spectrum across the whole reproduction band more accurately than a conventional decoding device.

BRIEF DESCRIPTION OF DRAWINGS

FIGS. 5A, 5B, and 5C show data structures of a bit stream into which a stream output unit shown in FIG. 3 places a second encoded signal (sharing information).

FIG. 16 is a table showing difference in quantization results between the encoding device of the present invention and the conventional encoding device by using specific values.

BEST MODE FOR CARRYING OUT THE INVENTION

First Embodiment

Figure 1:
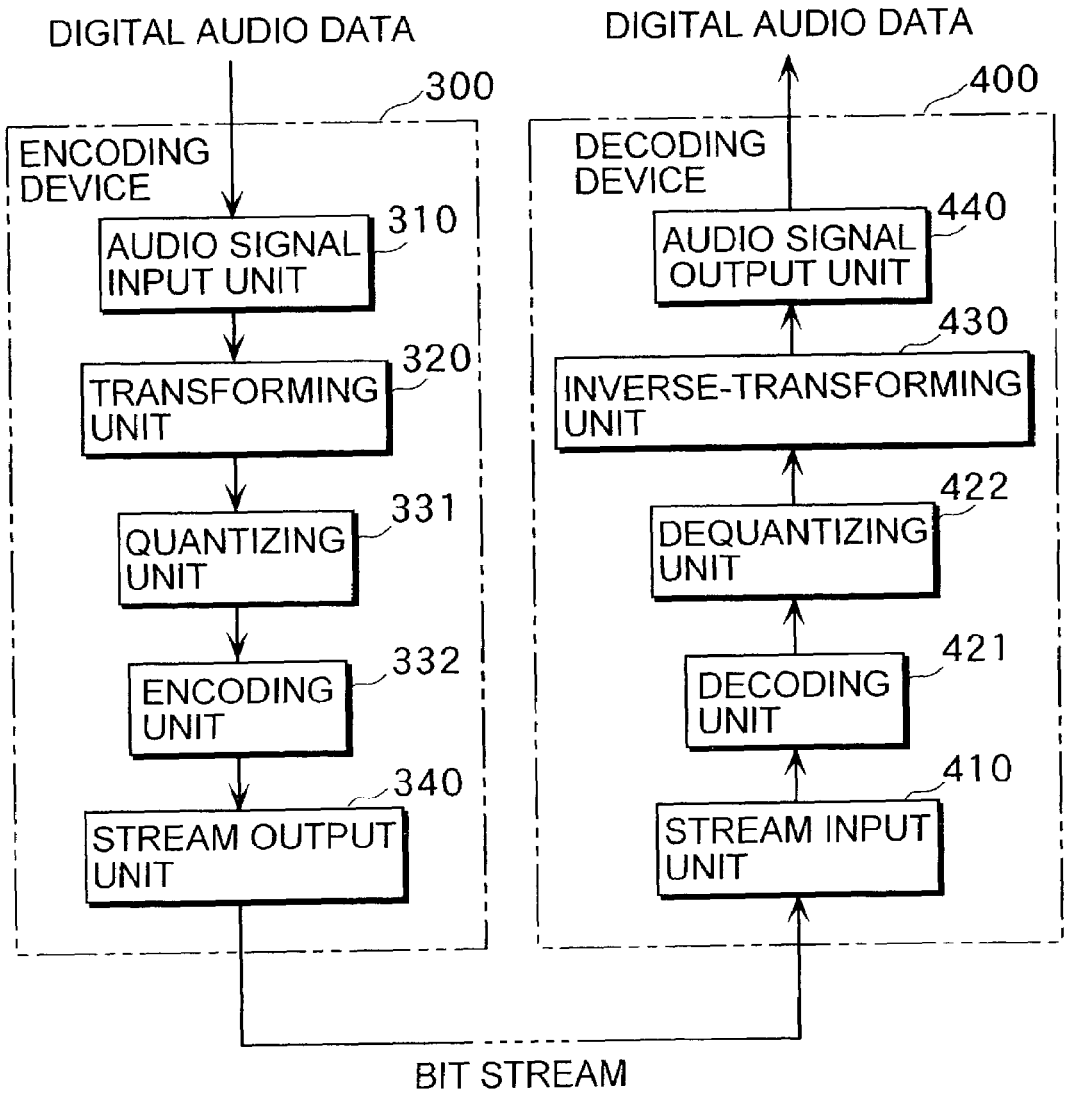
FIG. 1 is a block diagram showing constructions of the conventional encoding and decoding devices that conform to conventional MPEG-2 AAC.
Figure 2:
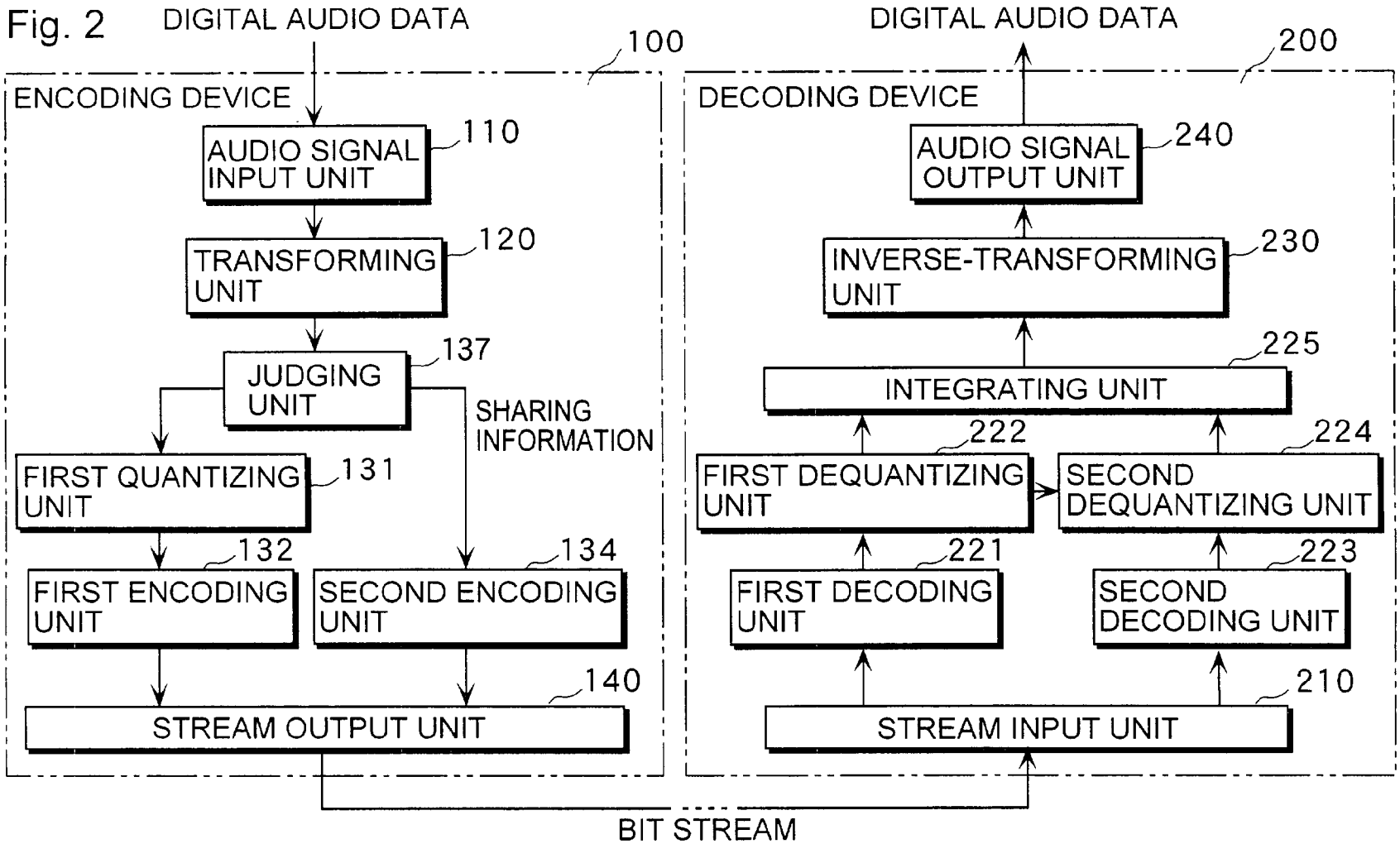
FIG. 2 is a block diagram showing constructions of an encoding device and a decoding device of the present invention.

The following specifically describes an encoding device 100 and a decoding device 200 as embodiments of the present invention. FIG. 2 is a block diagram showing constructions of the encoding device 100 and the decoding device 200.

Encoding Device 100

This encoding device 100 effectively reduces the bit amount of an encoded audio bit stream before transmitting it. When the present encoding device 100 and a conventional encoding device produce encoded audio bit streams of the same amount of bits, an audio bit stream produced by the preset encoding device 100 can be reconstructed by the decoding device 200 as an audio signal at higher quality than an audio bit stream produced by the conventional encoding device. More specifically, the encoding device 100 reduces the bit amount of the encoded audio bit stream as follows. For short blocks, the encoding device 100 transmits eight blocks (i.e., windows) collectively with each window composed of 128 samples. When different sets of spectral data in the higher frequency band are similar over two or more windows, the encoding device 100 has one of the sets of spectral data represent other similar sets of spectral data to reduce its amount of bits. Hereafter, spectral data in the higher frequency band is called "higher-frequency spectral data". The encoding device 100 comprises an audio signal input unit 110, a transforming unit 120, a first quantizing unit 131, a first encoding unit 132, a second encoding unit 134, a judging unit 137, and a stream output unit 140.

The audio signal input unit 110 receives digital audio data like MPEG-2 AAC digital audio data. This digital audio data is sampled at a sampling frequency of 44.1 kHz. From this digital audio data, the audio signal input unit 110 extracts 128 samples in a cycle of about 2.9 milliseconds (msec), and additionally obtains two sets of 64 samples, of which one set immediately precedes the extracted 128 samples and the other set immediately follows the 128 samples. These two sets of 64 samples overlap with other two sets of 128 samples that are extracted immediately before and after the present 128 samples. Accordingly, 256 samples are obtained in total through one extraction. (Hereafter, digital audio data thus obtained by the audio signal input unit 112 is called "sampled data".)

As with the conventional technique, the transforming unit 120 transforms the sampled data in the time domain into spectral data in the frequency domain. According to MPEG-2 AAC, MDCT is performed on sampled data composed of 256 samples so that spectral data composed of 256 samples based on short blocks is produced. Distribution of values of the spectral data generated as a result of MDCT conversion is symmetrical, and therefore only half (i.e., 128 samples) of the 256 samples are used for the subsequent operations. Such unit consisting of 128 samples is hereafter called a window. Eight windows, that is, 1,024 samples constitute one frame.

The transforming unit 113 then divides spectral data in each window into a plurality of groups that each include at least one sample (or, practically speaking, samples whose total number is a multiple of four). Each such group is called a scale factor band. For MPEG-2 AAC, the total number of scale factor bands included in a frame is defined based on the block size and the sampling frequency, and the number of samples of spectral data included in each scale factor band is also defined based on the frequency. Samples in the lower frequency bands are more finely divided into groups of scale factor bands that each include fewer samples, whereas samples in the higher frequency bands are more roughly divided into groups of scale factor bands that each contain more samples. When the short block and the sampling frequency of 44.1 kHz are used, each window contains 14 scale factor bands, and 128 samples in each window represent a 22.05-kHz reproduction band.

Figures 3A, 3B:
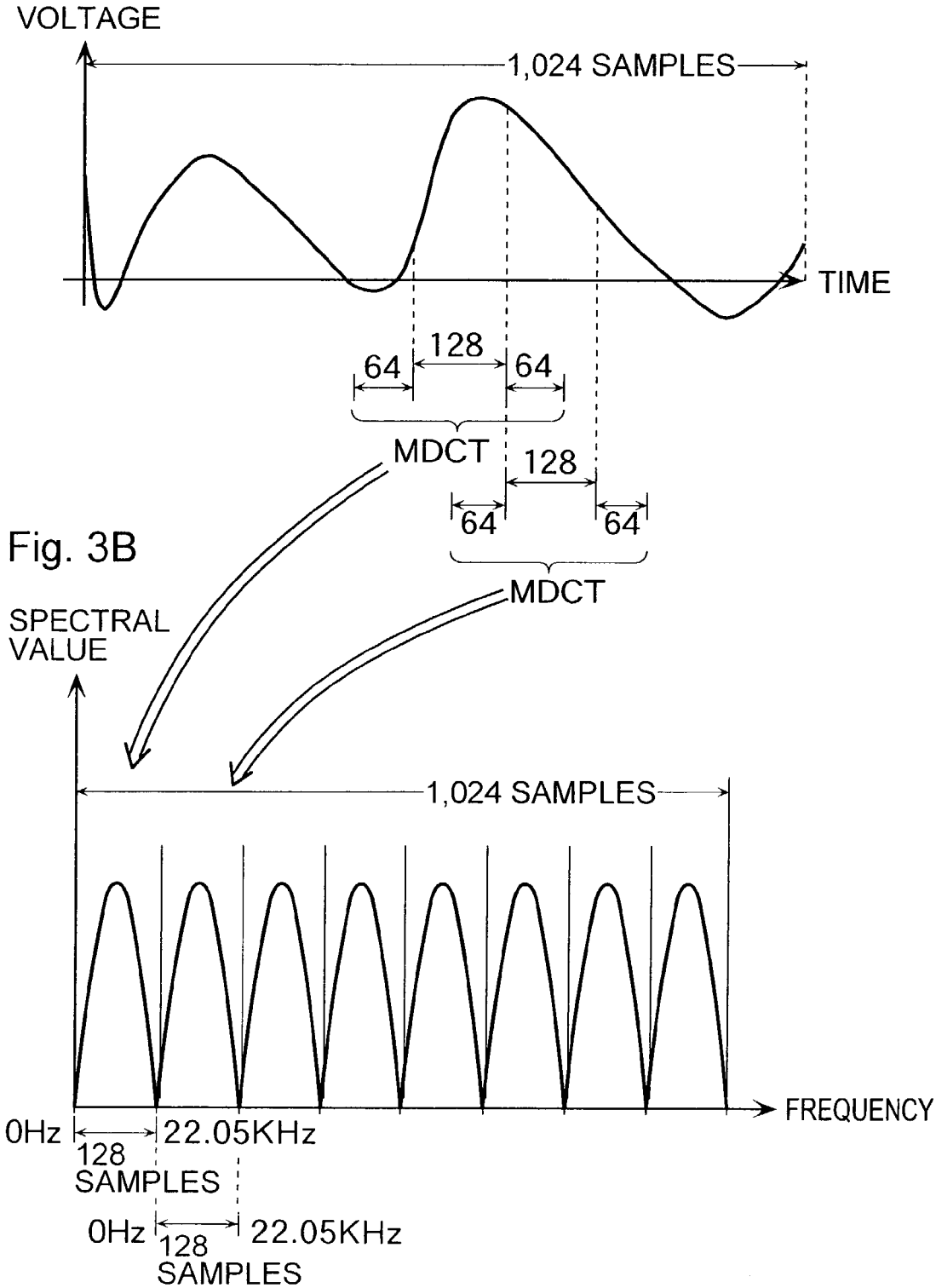
FIGS. 3A and 3B show the process in which the encoding device shown in FIG. 2 transforms an audio signal.

FIGS. 3A and 3B show the process of audio-signal conversion by the encoding device 100 shown in FIG. 2. FIG. 3A shows a waveform of sampled data in the time domain which is extracted by the audio signal input unit 110 in units of short blocks. FIG. 3B shows a waveform of the spectral data corresponding to a frame on which MDCT has been performed by the transforming unit 120. The vertical and horizontal axes of this graph represent spectral values and frequencies, respectively. Although the sampled data and the spectral data are represented in FIGS. 3A and 3B by the analog waveforms, they are actually digital signals. This applies to waveforms shown in subsequent figures. Also note that spectral data on which MDCT has been performed, such as shown in FIG. 3B, can take minus values although FIG. 3B shows the waveform formed only by plus values for ease of explanation.

The audio signal input unit 110 receives the digital audio signal as shown in FIG. 3A, extracts 128 samples from the digital audio signal, and additionally obtains two sets of 64 samples, of which one set immediately precedes the extracted 128 samples and the other set immediately follows the same 128 samples. These two sets of 64 samples overlap with part of other two sets of 128 samples that are extracted immediately before and after the 128 samples extracted through the current extraction. The audio signal input unit 110 therefore obtains 256 samples in total, and outputs them as sampled data to the transforming unit 120. The transforming unit 120 transforms this sampled data according to MDCT to produce spectral data composed of 256 samples. As spectral data transformed according to MDCT form a symmetrical spectrum, only half the 256 samples, that is, 128 samples are processed in subsequent operations. FIG. 3B shows spectral data generated in this way and composed of eight windows corresponding to a frame. Each window includes 128 samples that are generated approximately every 2.9 msec. That is to say, 128 samples in each window in FIG. 3B represent the bit amount (i.e., the size) of frequency components of the audio signal composed of 128 samples that are shown in FIG. 3A as voltage.

The judging unit 137 makes a judgment on spectral data in each of the eight windows outputted from the transforming unit 120 as follows. The judging unit 137 judges whether spectral data in the higher frequency band in a window can be represented by another higher-frequency spectral data in another window. When judging so, the judging unit 137 changes values of higher-frequency spectral data in one of the two windows to "0". This judgment can be made, for instance, by specifying an energy difference between two sets of spectral data in two adjacent windows. If the specified energy difference is smaller than a predetermined threshold, the judging unit 137 judges that spectral data in one of the two windows can be represented by the other set of spectral data in the other preceding window. After this, the judging unit 137 generates, for each window, a flag indicating whether spectral data in a currently judged window can be represented by another preceding spectral data in another preceding window. The judging unit 137 then generates sharing information that includes the generated flags to show which window can share spectral data with another window.

The first quantizing unit 131 receives the spectral data from the judging unit 137, and determines a scale factor for each scale factor band. The first quantizing unit 131 then normalizes and quantizes spectral data in each scale factor band by using a determined scale factor to produce quantized data, and outputs the quantized data and the used scale factors to the first encoding unit 132. In more detail, the first quantizing unit 131 determines an appropriate scale factor for each scale factor band so that a resulting encoded frame has amount of bits within a range of a transfer rate of a transmission channel.

The first encoding unit 132 receives 1,024 samples of the quantized data and the scale factors used for the quantization, and encodes them according to Huffman encoding to produce a first encoded signal in a predetermined stream format. For encoding the scale factors, the first encoding unit 132 calculates differences in values of the scale factors, and encodes the calculated differences and a scale factor used in the first scale factor band within a frame.

The second encoding unit 134 receives the sharing information from the judging unit 137, and Huffman-encodes it to produce a second encoded signal in a predetermined stream format.

The stream output unit 140 receives the first encoded signal from the first encoding unit 132, adds header information and other necessary secondary information to the first encoded signal, and transforms it into an MPEG-2 AAC bit stream. The stream output unit 140 also receives the second encoded signal from the second encoding unit 134, and places it into a region, which is either ignored by a conventional decoding device or for which no operations are defined, of the above MPEG-2 AAC bit stream. Specifically this region may be Fill Element or Data Stream Element (DSE).

The bit stream outputted from the encoding device 100 is sent to the decoding device 200 via a communication network for portable phones and the Internet, and a transmission medium such as a broadcast wave of a cable TV and a digital TV. This bit stream also may be recorded on a recording medium, such as an optical disc including a CD and a DVD, a semiconductor, and a hard disk.

In actual MPEG-2 AAC, other techniques may be additionally used, which include tools such as gain control, Temporal Noise Shaping (TNS), a psychoacoustic model, M/S (Mid/Side) stereo, intensity stereo, prediction, and others such as a bit reservoir and a method for changing the block size.

Decoding Device 200

The decoding device 200 receives the encoded bit stream, and reconstructs digital audio data in a wide frequency band from the bit stream according to the sharing information. The decoding device 200 includes a stream input unit 210, a first decoding unit 221, a first dequantizing unit 222, a second decoding unit 223, a second dequantizing unit 224, an integrating unit 225, an inverse-transforming unit 230, and an audio signal output unit 240.

The stream input unit 210 receives the encoded bit stream from the encoding device 100 via either a recording medium or a transmission medium, including a communication network for portable phones, the Internet, a transmission channel of a cable TV, and a broadcast wave. The stream input unit 210 then extracts the first encoded signal from a region, which is decoded by the conventional decoding device 400, of the encoded bit stream. The stream input unit 210 also extracts the second encoded signal (sharing information) from another region, which is either ignored by the conventional decoding device 400 or for which no operations are defined, of the same bit stream. The stream input unit 210 outputs the first and second encoded signals to the first and second decoding units 221 and 223, respectively.

The first decoding unit 221 receives the first encoded signal, that is, Huffman-encoded data in the stream format, decodes it into quantized data, and outputs the quantized data The second decoding unit 223 receives the second encoded signal, decodes it into the sharing information, and outputs the sharing information.

While referring to the sharing information outputted from the second decoding unit 223, the second dequantizing unit 224 duplicates and outputs a part of spectral data that is outputted by the first dequantizing unit 222 and that is shared by two windows.

The integrating unit 225 integrates two sets of spectral data outputted from the first and second dequantizing units 223 and 224 together. More specifically, the integrating unit 225 receives spectral data from the first dequantizing unit 222 and also receives spectral data and designation of frequencies from the second dequantizing unit 224. The integrating unit 225 then changes values of the spectral data, which is received from the first dequantizing unit 222 and specified by the above-designated frequencies, into values of the spectral data outputted from the second dequantizing unit 224. Similarly, when receiving higher-frequency spectral data and designation of a window from the second dequantizing unit 224, the integrating unit 225 changes values of higher-frequency spectral data, which is specified by the designated window and outputted from the first dequantizing unit 222, to values of the higher-frequency spectral data received from the second quantizing unit 224.

The inverse-transforming unit 230 receives the integrated spectral data from the integrating unit 225, and performs IMDCT on the spectral data in the frequency domain into sampled data composed of 1,024 samples in the time domain.

The audio signal output unit 240 sequentially puts together sets of sampled data outputted from the inverse-transforming unit 230 to produce and output digital audio data.

In the present embodiment, higher-frequency spectral data in one window represents another higher-frequency spectral data in another window out of the eight windows as described above. This reduces the bit amount of transmitted data by the bit amount of spectral data shared between different windows while minimizing degradation in reconstructing spectral data.

Figure 4:
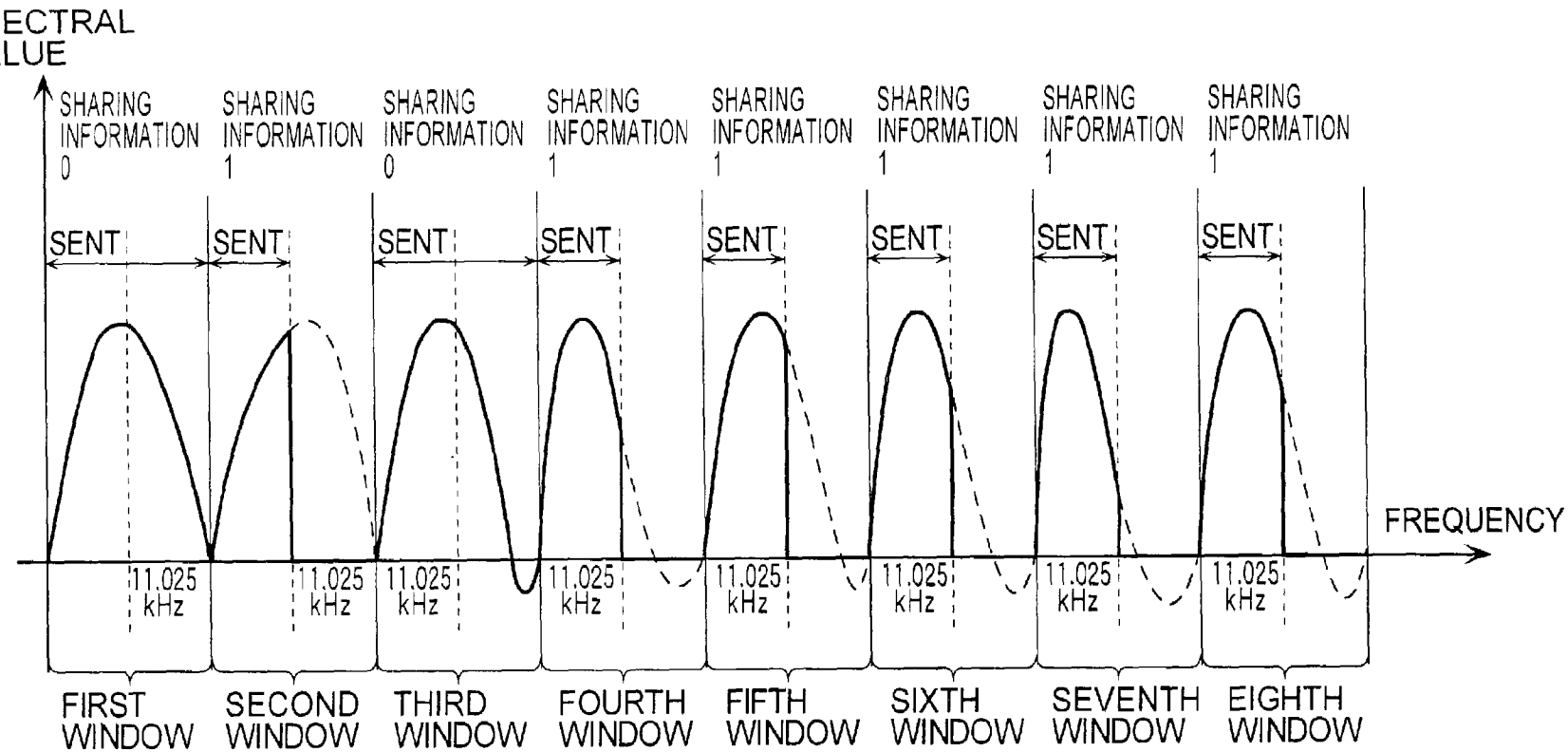
FIG. 4 shows an example of how a judging unit shown in FIG. 2 judges higher-frequency spectral data as being represented by other spectral data.

FIG. 4 shows, as one example, how higher-frequency spectral data is shared between different windows in accordance with the judgment by the judging unit 137. The spectral data shown in this figure corresponds to one frame, and is generated from short blocks as in FIG. 3B. Each window shown in FIG. 4 is divided by a vertical dotted line into two, with the left half representing a lower frequency reproduction band from 0 kHz to 11.025 kHz, and the right half representing a higher frequency reproduction band from 11.025 kHz to 22.05 kHz.

Two spectrums included in two adjacent windows are likely to take a similar waveform as shown in FIG. 4 because each window is extracted in short cycles. In such case, the judging unit 137 judges that higher-frequency spectral data in one of the two windows represents higher-frequency spectral data in the other window. For instance, assume that spectrums in the first and second windows are similar and that spectrums in windows from the third to the eighth windows are similar. The judging unit 137 then judges that higher-frequency spectral data is shared between the first and second windows and that another higher-frequency spectral data is shared by the third and subsequent windows. In this case, sets of spectral data within ranges indicated by arrows in the figure are transmitted (as well as quantized and encoded). Other sets of higher-frequency spectral data in the second window and the windows from the fourth to the eight windows are not transmitted, and values of these sets of spectral data are changed by the judging unit 137 to "0".

FIGS. 5A–5C show data structures of encoded bit streams into which the second encoded signal containing sharing information is placed by the stream output unit 140. FIG. 5A shows regions of such encoded bit stream, and FIGS. 5B and 5C show example data structures of the MPEG-2 AAC bit stream. A shaded part shown in FIG. 5B is the Fill Element region, which is filled with "0" to adjust the data length of the bit stream. A shaded part shown in FIG. 5C is the DSE region, for which only physical structure, such as a bit length, is defined for its future extension according to MPEG-2 AAC. As shown in FIG. 5A, the sharing information encoded by the second encoding unit 134 is given ID (identification) information and placed into a region, such as Fill Element and DSE, of the bit stream.

When the conventional decoding device 400 receives the bit stream including the second encoded signal in the Fill Element region, the decoding device 400 does not detect the second encoded signal as a signal to be decoded, and only ignores it. When receiving the bit stream including the second encoded signal in the DSE region, the conventional decoding device 400 may read the second encoded signal but it does not perform any operations in response to this reading because no operations responding to the second encoded signal are defined for the decoding device 400. By inserting the second encoded signal into one of the above regions of the bit stream, the conventional decoding device 400 receiving the bit stream encoded by the encoding device 100 does not decode the second encoded signal as an encoded audio signal. This therefore prevents the conventional decoding device 400 from producing noise resulting from failed decoding of the second encoded signal. As a result, even the conventional decoding device 400 can reproduce sound from the first encoded signal alone without any trouble in a conventional manner.

The Fill Element region, into which the second encoded signal may be placed, is originally provided with header information as shown in FIG. 5A. This header information includes information, such as Fill Element ID that identifies this Fill Element, and data specifying a bit length of the whole Fill Element. Similarly, the DSE region, into which the second encoded signal may be placed, is also provided with header information as shown in FIG. 5A. This header information includes information, such as DSE ID indicating that the subsequent data is DSE, and data specifying a bit length of the whole DSE. The stream output unit 140 places the second encoded signal, which includes the ID information and the sharing information, into a region that follows the region storing the header information.

The ID information shows whether the subsequent encoded information is generated by the encoding device 100 of the present invention. For instance, the ID information shown as "0001" indicates that the subsequent information is the sharing information encoded by the encoding device 100. On the other hand, the ID information shown as "1000" indicates that the subsequent information is not encoded by the encoding device 100. When the ID information is shown as "0001", the decoding device 200 of the present invention has the second decoding unit 223 decode the subsequent encoded information to obtain the sharing information, and reconstructs higher-frequency spectral data in each window in accordance with the obtained sharing information. When the ID information is shown as "1000", however, the decoding device 200 ignores the subsequent encoded information. Such ID information is placed into the second encoded signal so as to clearly distinguish the second encoded signal of the present invention from other encoded information based on other standards, which may be inserted into regions, such as Fill Element and DSE, that are not detected by the conventional decoding device 400 as storing an encoded audio signal to be decoded.

The above ID information is also useful in that it can be used for notifying the decoding device 200 that the second encoded signal also includes other additional information (such as sub information) based on the present invention other than the sharing information if such additional information is provided as described in the subsequent embodiments. The ID information does not have to be placed at the start of the second encoded signal, and may be placed in a region that either follows the encoded sharing information or is a part of the sharing information.

Figure 6A:
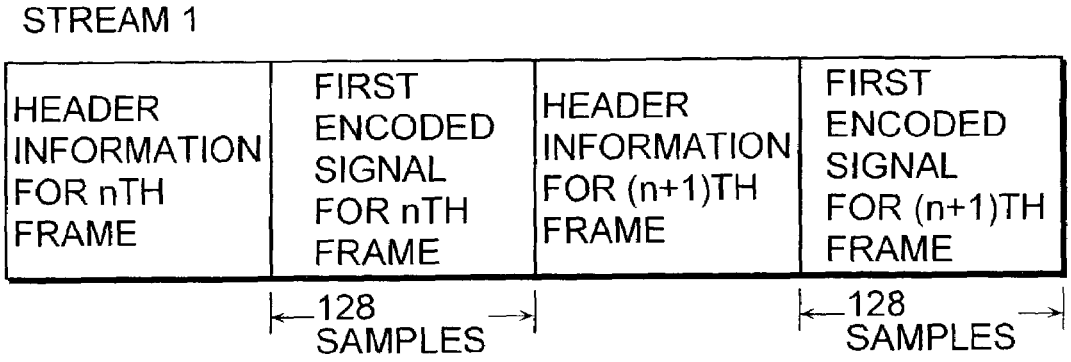
FIGS. 6A, 6B, and 6C show other data structures of a bit stream into which the stream output unit places the second encoded signal.
Figure 6B:
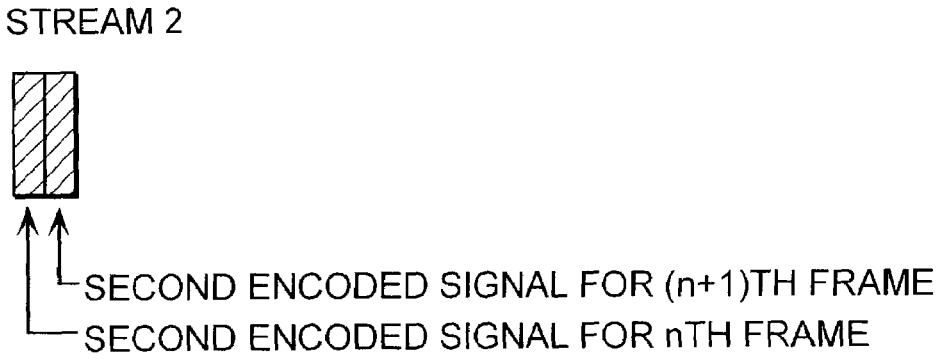
Figure 6C:
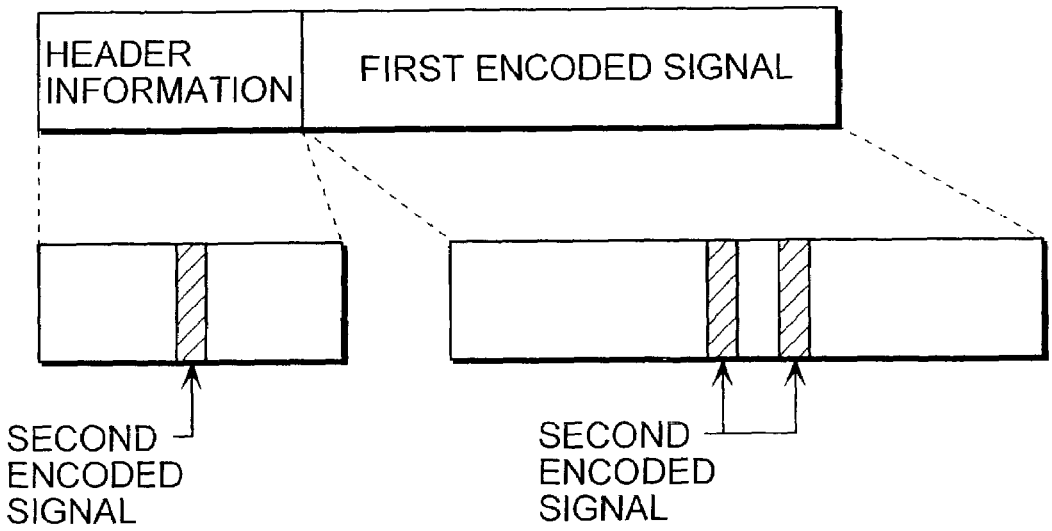

FIGS. 6A–6C show other example data structures of the encoded audio bit streams into which the stream output unit 140 places the first and second encoded signals. The encoded audio bit streams shown in these figures do not necessarily conform to MPEG-2 AAC. FIG. 6A shows a stream 1 that stores the first encoded signals that each correspond to a different frame. FIG. 6B shows a stream 2 that consecutively stores the second encoded signal alone in units of frames corresponding to frames of the stream 1. This stream 2 stores, for each frame, the sharing information to which the header information and the ID information are added as shown in FIG. 5A. As shown in FIGS. 6A and 6B, the stream output unit 140 may place the first and second encoded signals into the separate streams 1 and 2, which may be transmitted via different channels.

When the first and second encoded signals are transmitted via different bit streams, it becomes possible to first transmit or accumulate a bit stream including information relating to audio data in the lower frequency band, which is basic information, and to later transmit or add information relating to the higher-frequency spectral data as necessary.

When the encoded audio bit stream containing the second encoded signal is produced targeting the decoding device 200 of the present invention alone, the second encoded signal may be inserted into a certain region, other than the above-stated regions, of the header information with this certain region determined in advance by the encoding device 100 and the decoding device 200. It is alternatively possible to insert the second encoded signal into a predetermined part of the first encoded signal, or into both the predetermined part and the stated certain region of the header information. When the second encoded signal is inserted in the stated part and/or region, the stated part/region does not have to be a single consecutive region and may be instead scattering regions. FIG. 6C shows such example data structure of an encoded audio bit stream storing the second encoded signal in scattering regions of both the header information of the audio bit stream and the first encoded signal. In this case too, the ID information and header information are added to the sharing information to be stored as the second encoded signal in the audio bit stream.

Figure 7:
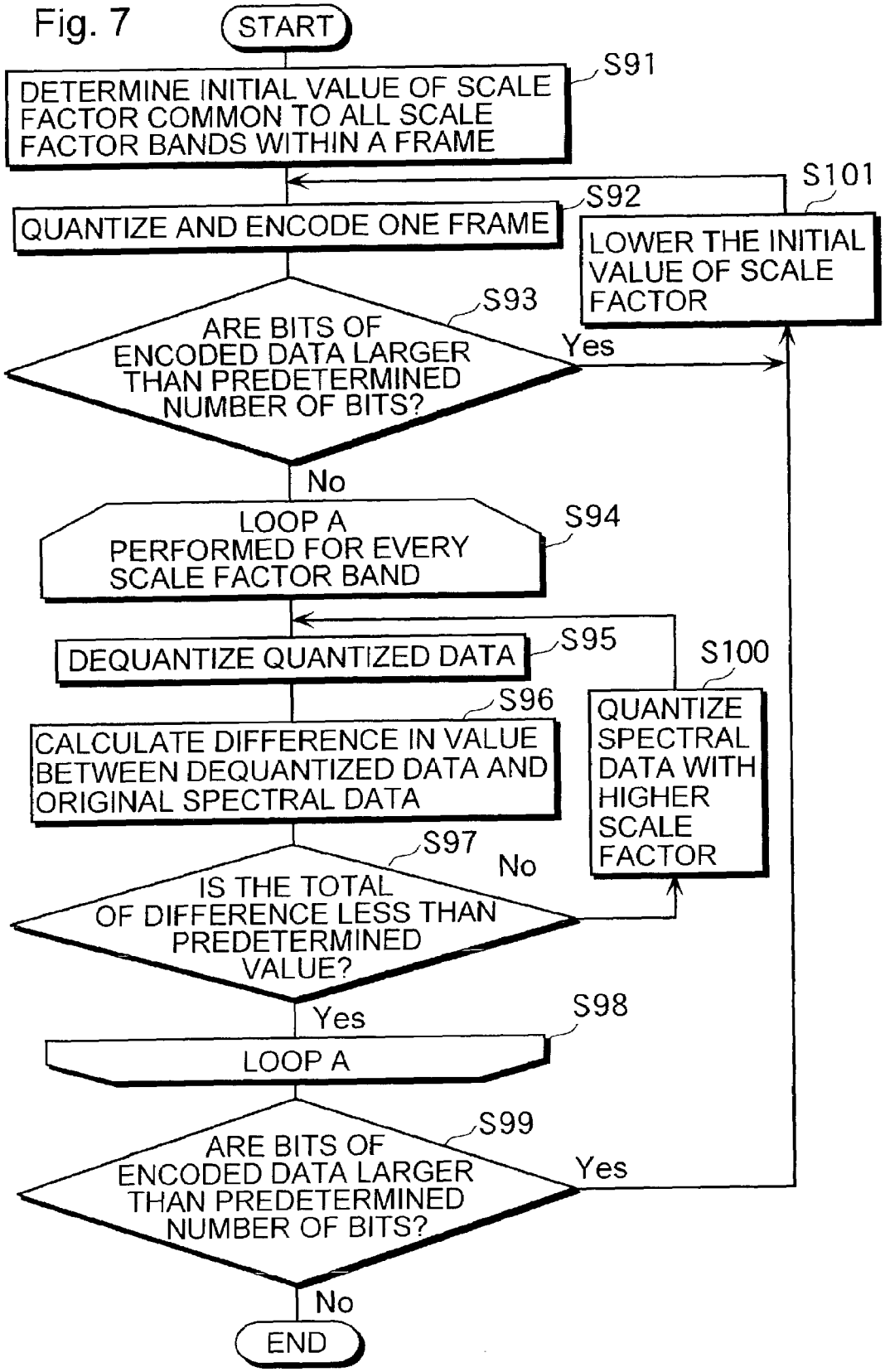
FIG. 7 is a flowchart showing an operation performed by a first quantizing unit shown in FIG. 2 to determine a scale factor.
Figure 8:
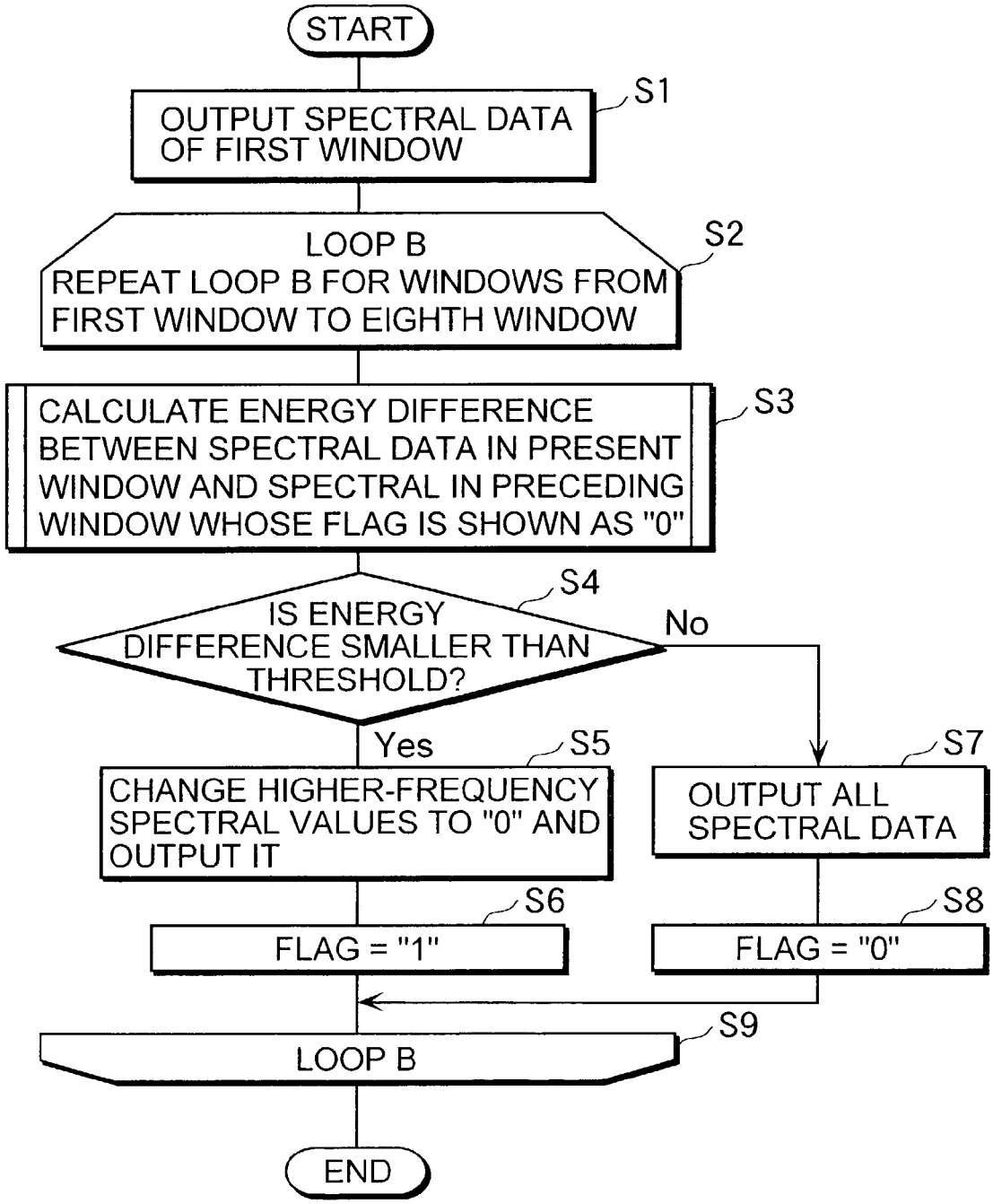
FIG. 8 is a flowchart showing an example operation performed by the judging unit to make judgment on shared spectral data within a frame.
Figure 10:
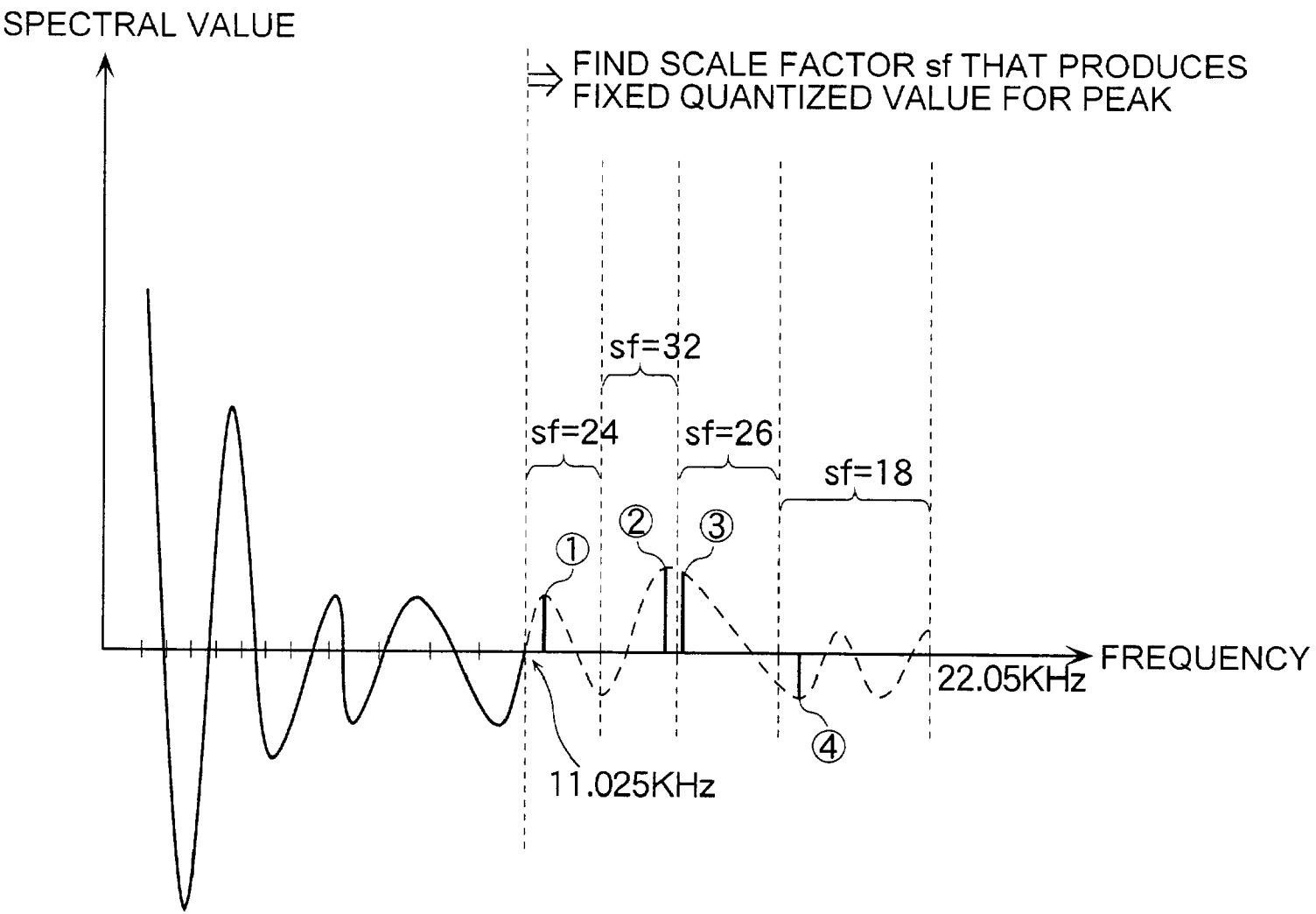
FIG. 10 shows a waveform of spectral data as a specific example of sub information (scale factors) produced by the judging unit for each window based on short blocks.
Figure 11:
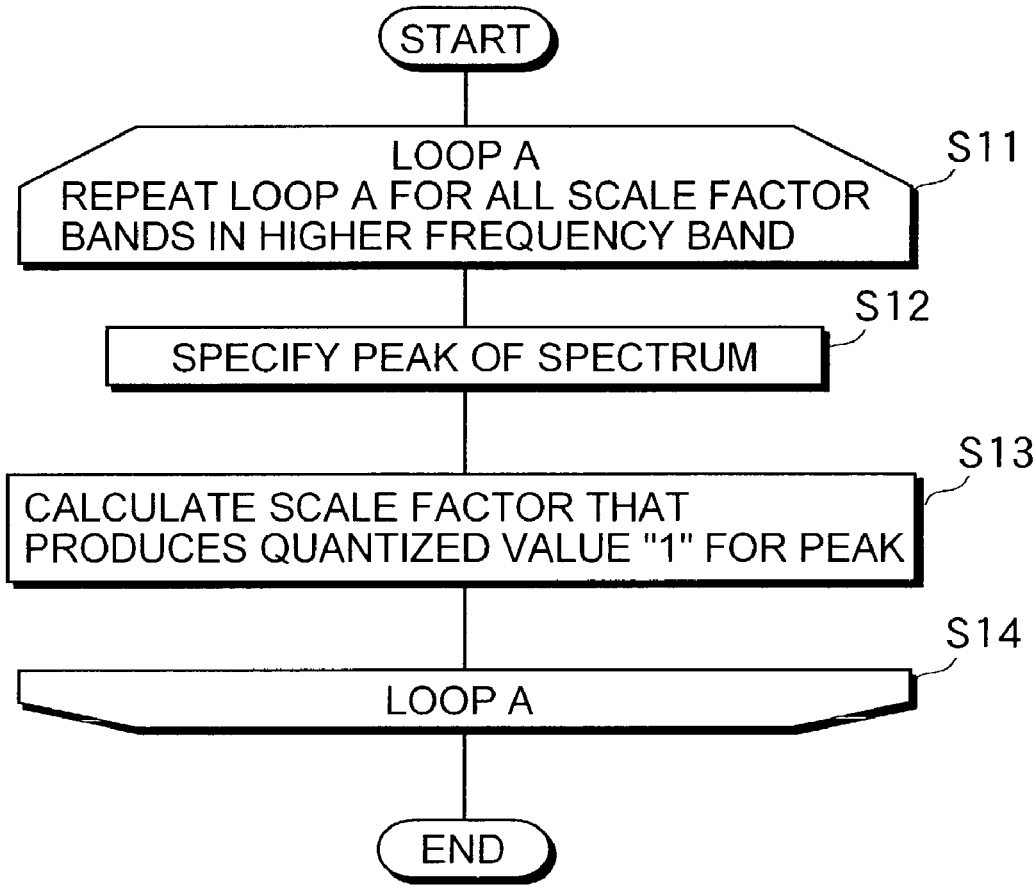
FIG. 11 is a flowchart showing the operation performed by the judging unit to produce the sub information.

The following describes operations of the encoding device 100 and the decoding device 200 with reference to flowcharts of FIGS. 7, 8, and 11, and a waveform diagram of FIG. 10.

FIG. 7 is a flowchart showing the operation performed by the first quantizing unit 131 to determine a scale factor for each scale factor band. The first quantizing unit 131 determines an initial value of a scale factor common to all the scale factor bands corresponding to a frame (step S91). With the scale factor of the determined initial value, the first quantizing unit 131 quantizes the spectral data for a frame outputted from the judging unit 137 so as to produce quantized data, calculates a difference in scale factors used in every two adjacent scale factor bands, and Huffman-encodes the quantized data, the calculated differences, and a scale factor used in the first scale factor band of the frame (step S92) so as to produce Huffman-encoded data. The above quantization and encoding are performed only for counting the total number of bits of the frame, and therefore information such as a header is not added to the result of the quantization and encoding. After this, the first quantizing unit 131 judges whether the number of bits of the Huffman-encoded data exceeds a predetermined number of bits (step S93). If so, the first quantizing unit 131 lowers the initial value of the scale factor (step S101), and performs quantization and Huffman encoding with the scale factor of the lowered initial value. The first quantizing unit 131 then judges whether the number of bits of the Huffman-encoded data exceeds the predetermine number of bits (step S93). The first quantizing unit 131 repeats these steps until it judges that the number of bits of the Huffman-encoded data does not exceed the predetermine number of bits.

On judging that the number of bits of the Huffman-encoded data does not exceed the predetermine number of bits, the first quantizing unit 131 repeats a loop A (steps S94~S98 and S100) to determine a scale factor for each scale factor band. That is to say, the first quantizing unit 131 dequantizes each set of quantized data, which is produced in step S92, in a scale factor band to produce a set of dequantized spectral data (step S95), and calculates a difference in absolute values between the produced set of dequantized spectral data and a set of original spectral data corresponding to this dequantized spectral data. The first quantizing unit 131 then totals such differences calculated for all the sets of dequantized spectral data within the scale factor band (step S96). After this, the first quantizing unit 131 judges whether the total of the differences is less than a predetermined value (step S97). If so, the first quantizing unit 131 performs the loop A for the next scale factor band (steps S94~S98). If not, the first quantizing unit 131 raises the value of the scale factor and quantizes each set of original spectral data in the same scale factor band by using the raised scale factor (step S100). The first quantizing unit 131 then dequantizes each set of quantized data (step S95), calculates a difference in absolute values between each set of dequantized spectral data and a set of original spectral data that corresponds to the set of dequantized spectral data, and totals the calculated differences (step S96). After this, the first quantizing unit 131 judges again whether the total of the differences is less than a predetermined value (step S97). If not, the first quantizing unit 131 raises the scale factor value (step S100), and repeats the loop A (steps S94~S98 and S100).

After specifying scale factors, for all the scale factor bands within the frame, each of which makes the above total of the differences less than the predetermined value (step S98), the first quantizing unit 131 quantizes all the sets of spectral data corresponding to the frame by using the specified scale factors so that sets of quantized data are produced. The first quantizing unit 131 then Huffman-encodes all the sets of quantized data, differences in each pair of scale factors used in two adjacent scale factor bands, and a scale factor used in the first scale factor band so that encoded data is produced. The first quantizing unit 131 then judges if the number of bits of the encoded data exceeds the predetermined number of bits (step S99). If so, the first quantizing unit 131 lowers the initial value of the scale factor (step S101) until the number of bits becomes equal to or less than the predetermined number of bits, and executes the loop A (steps S94~S98 and S100) to determine a scale factor of each scale factor band. When judging that the number of bits of the encoded data does not exceed the predetermined number of bits (step S99), the first quantizing unit 131 determines each scale factor specified in the loop A as an actual scale factor for each scale factor band within the frame.

Note that the first quantizing unit 131 makes the above judgment in step S97 (as to whether the total of the differences is less than the predetermined value) in accordance with data such as that relating to a psychoacoustic model.

In the above operation shown in FIG. 7, the first quantizing unit 131 first sets a relatively large value as the initial value of the scale factor, and lowers this initial value if the number of bits of the Huffman-encoded data exceeds the predetermined bit number, although this is not necessary. That is to say, the first quantizing unit 131 may instead set a relatively low value as the initial value of the scale factor, and gradually raise this initial value until it judges that the number of bits of the Huffman-encoded data exceeds the predetermined number of bits. When judging so, the first quantizing unit 131 specifies the initial value that was set immediately before the currently set initial value as the initial value of the scale factor.

Also in the above operation shown in FIG. 7, a scale factor for each scale factor band is determined in such a way as to make the number of bits of the whole Huffman-encoded data for a frame less than the predetermined number of bits, although this is not necessary. That is to say, each scale factor may be determined in such a way as to make the number of bits of each set of quantized data in each scale factor band less than a predetermined number of bits.

FIG. 8 is a flowchart showing example operation performed by the judging unit 137 to make the judgment regarding spectral data to be shared within a frame and to produce the judgment result as the sharing information. Here, the judging unit 137 produces the judgment result for eight windows as the sharing information composed of eight flags (i.e., eight bits), out of which a flag shown as "0" indicates that higher-frequency spectral data within a window with this flag will be transmitted to the decoding device 200, and a flag shown as "1" indicates that higher-frequency spectral data within a window with this flag is represented by other higher-frequency spectral data within another window.

From the transforming unit 120, the judging unit 137 receives spectral data in the first window out of the eight windows, outputs the received spectral data to the first quantizing unit 131, and sets the first flag (i.e., bit) of the sharing information as "0" (step S1). Following this, the judging unit 137 repeatedly performs a loop B (steps from S2 to S9) to make the judgment for each of the remaining seven windows from the second to the eighth windows as follows.

The judging unit 137 focuses on a window, and calculates an energy difference between spectral data in this window and spectral data in a preceding window whose flag is shown as "0" and which exists nearest the focused-on window (step S3). The judging unit 137 then judges whether the calculated energy difference is smaller than a predetermined threshold (step S4).

If so, the judging unit 137 determines that the focused-on window and the preceding window include a similar spectrum and that higher-frequency spectral data within the focused-on window therefore can be represented by higher-frequency spectral data within the preceding window. The judging unit 137 then changes values of the higher-frequency spectral data in the focused-on window to "0" (step S5), and sets a bit, which corresponds to this window, of the sharing information as "1" (step S6). On the other hand, when judging that the energy difference is not smaller than the predetermined threshold, the judging unit 137 determines that the higher-frequency spectral data within the focused-on window cannot be represented by the higher-frequency spectral data within the preceding window. In this case, the judging unit 137 outputs all the spectral data within the focused-on window to the first quantizing unit 131 as it is (step S7), and sets the bit of the sharing information corresponding to the focused-on window as "0" (step S8).

For instance, assume that the judging unit 137 currently focuses on the second window. The judging unit 137 then calculates a difference in spectral values of the same frequency between the second window and the first window, each of which is composed of 128 samples. The judging unit 137 then totals all the differences calculated for the two windows so as to specify an energy difference of spectral data between the first window and the second window (step S3), and judges whether the energy difference is smaller than the predetermined threshold (step S4).

When judging that the energy difference is smaller than the predetermined threshold, the judging unit 137 determines that the first and second windows include a similar spectrum and that higher-frequency spectral data in the second window can be represented by higher-frequency spectral data in the first window. The judging unit 137 therefore changes values of the higher-frequency spectral data in the second window to "0" (step S5), and sets a bit, which corresponds to the second window, of the sharing information as "1" (step S6).

This completes the judgment on the second window (step S9), and therefore the judging unit 137 performs the loop B on the third window (step S2). That is to say, the judging unit 137 calculates an energy difference in spectral data between the first and third windows (step S3). In more detail, the judging unit 137 calculates a difference in spectral values of the same frequency between the first window and the third window. The judging unit 137 then totals all the calculated differences to specify the energy difference in spectral data between the first window and the third window, and judges whether the specified energy difference is smaller than the predetermined threshold (step S4).

On judging that the energy difference is not smaller than the predetermined threshold, the judging unit 137 determines that the two spectrums in the first and third windows are not similar to each other and that the spectral data in the third window cannot be represented by the spectral data in the first window. In this case also, the judging unit 137 outputs all the spectral data within the third window to the first quantizing unit 131 as it is (step S7), and sets the bit of the sharing information for the third window as "0" (step S8).

This completes the judgment on the third window (step S9), and therefore the judging unit 137 performs the loop B for the fourth window (step S2). The judging unit 137 calculates an energy difference in spectral data between the fourth window and a preceding window which exists nearest the fourth window and whose flag is shown as "0" (i.e., whose spectral data are outputted as it is without being replaced with "0"). The preceding window is therefore the third window. In this way, the judging unit 137 repeats the judgment based on the loop B until it completes the judgment on the eighth window, so that it finishes the operation for the entire frame. Consequently, spectral data within this frame has been outputted to the first quantizing unit 131, and 8-bit sharing information shown as "01011111" is generated for this frame. This sharing information indicates that higher-frequency spectral data in the first window represents higher-frequency spectral data in the second window and that higher-frequency spectral data in the third window represents higher-frequency spectral data in consecutive windows from the fourth window to the eighth window. This sharing information may be expressed otherwise. For instance, when it is predetermined that the entire spectral data of the first window, including higher-frequency spectral data, is always transmitted, the first bit of the sharing information may be omitted so that the sharing information may be expressed by seven bits "1011111". The judging unit 137 then outputs the generated sharing information to the second encoding unit 134, and performs the above operation on the next frame.

In the above operation, the judging unit 137 specifies the energy difference in spectrums in two windows through calculation using the whole 128 samples making up each window, although this is not necessary. It is instead possible to specify an energy difference in only higher-frequency 64 samples of the two windows. The judging unit 137 then may compare this specified energy difference with a predetermined threshold.

In the above operation, the judging unit 137 always outputs the higher-frequency spectral data in the first window as it is without replacing their values with "0", although this is not necessary. For instance, the judging unit 137 may find, out of eight windows in a frame, a window that has the smallest energy difference in relation to any one of remaining seven windows. The judging unit 137 may then transmit (as well as quantize and encode) the entire spectral data in either the found window alone or a predetermined number of windows that are arranged in order of the energy difference value, the smallest value first. In this case, higher-frequency spectral data in the first window is not always transmitted.

In the above embodiment, the judgment as to whether higher-frequency spectral data in one window can be represented by other higher-frequency spectral data in a preceding window is made based on calculation of the energy difference between the two windows. However, this judgment does not have to be based on the calculation of the energy difference, and the following modifications are possible. In one example modification, a position (i.e., a frequency) of a set of spectral data that has the highest absolute value of all the sets of spectral data within a window is specified on the frequency axis. This position on the frequency axis is specified in two windows and a difference between the two specified positions is found. When the found difference is smaller than a predetermined threshold, the judging unit 137 judges that higher-frequency spectral data in one window can be represented by other higher-frequency spectral data in the other window. In another example modification, the judging unit 137 may judge that the higher-frequency spectral data in one window can be represented by another higher-frequency spectral data in another window when the two windows include spectrums that have the same number of peaks and/or that have peaks whose positions on the frequency axis are similar to each other. The number of such peaks and their positions may be compared between scale factor bands of the two windows, and a score may be given to each window based on the similarity of spectrums so that the judgment is made on a spectrum from broader aspects within each window. As another example modification, a position of spectral data that has the highest absolute value in a window may be specified for two windows. When the positions specified for the two windows are similar to each other, it is also possible to judge that the higher-frequency spectral data in one window can be represented by the other higher-frequency spectral data in the other preceding window with the flag shown as "0". In another example modification, this judgment may be made by (a) executing a predetermined function for a spectrum in each window, (b) comparing the execution results in the two windows, and (c) making the above judgment based on this comparison result. As another example modification, it is alternatively possible to have a single set of higher-frequency spectral data shared between predetermined windows without referring to similarity between two sets of higher-frequency spectral data. For instance, spectral data in an odd-numbered window, such as the second, fourth, or sixth window, may represent spectral data in an even-numbered window, and vice versa. It is alternatively possible to decide, in advance, windows in which values of higher-frequency spectral data will never be replaced by "0". A single window, for instance, may be determined so that higher-frequency spectral data in this window represents higher-frequency spectral data in the other seven windows.

In another example modification, when each window includes a plurality of peaks in either its higher frequency band or the entire frequency band, frequencies of the plurality of peaks are specified. The frequencies specified in two different windows are then compared with each other to find a difference. When each found difference is within a predetermined threshold range, the judging unit 137 judges that higher-frequency spectral data in one of the windows can be represented by higher-frequency spectral data in the other window. It is alternatively possible to total each specified difference, and the judging unit 137 judges that higher-frequency spectral data is shared between the two windows if the totaled difference is less than a threshold.

The decoding device 200 receives the encoded audio bit stream generated by the encoding device 100, and has the first decoding unit 221 decode the first encoded signal in accordance with the conventional procedure to produce quantized data composed of 1,024 samples. When spectral data corresponding to this quantized data is generated based on the example procedure shown in FIG. 8, all the values of the higher-frequency spectral data are "0" in the second window and windows from the fourth to the eight windows. The second dequantizing unit 224 includes memory capable of storing at least higher-frequency spectral data for one window, which is outputted from the first dequantizing unit 222. The second dequantizing unit 224 refers to a flag of each window during dequantization for the window. When this flag is shown as "0", the second dequantizing unit 224 places, into the above memory, higher-frequency spectral data outputted from the first dequantizing unit 222. Following this, the second dequantizing unit 224 refers to a flag of the next window. When the flag is shown as "1", the second dequantizing unit 224 duplicates and outputs higher-frequency spectral data stored in the memory, and thereafter continues this duplication until it recognizes a window with a flag shown as "0". It is possible to use, as the above memory, conventionally provided memory, which is in the conventional decoding device 400 so as to store spectral data corresponding to a frame. It is therefore not necessary to provide new memory to the conventional decoding device 400. If memory is newly provided for achieving the present invention, new storage regions may be provided in this memory so as to store pointers that indicate the start of the window to be duplicated and the start of higher-frequency spectral data within this window. However, such new storage regions are unnecessary when a procedure is set in advance in the decoding device so that the decoding device can search the memory for the above two positions in accordance with frequencies of the two positions. Such new memory may be provided as necessary when the search time of the above two positions of spectral data should be reduced. The following describes the specific operation of the second dequantizing unit 224 with reference to a flowchart of FIG. 9.

Figure 9:
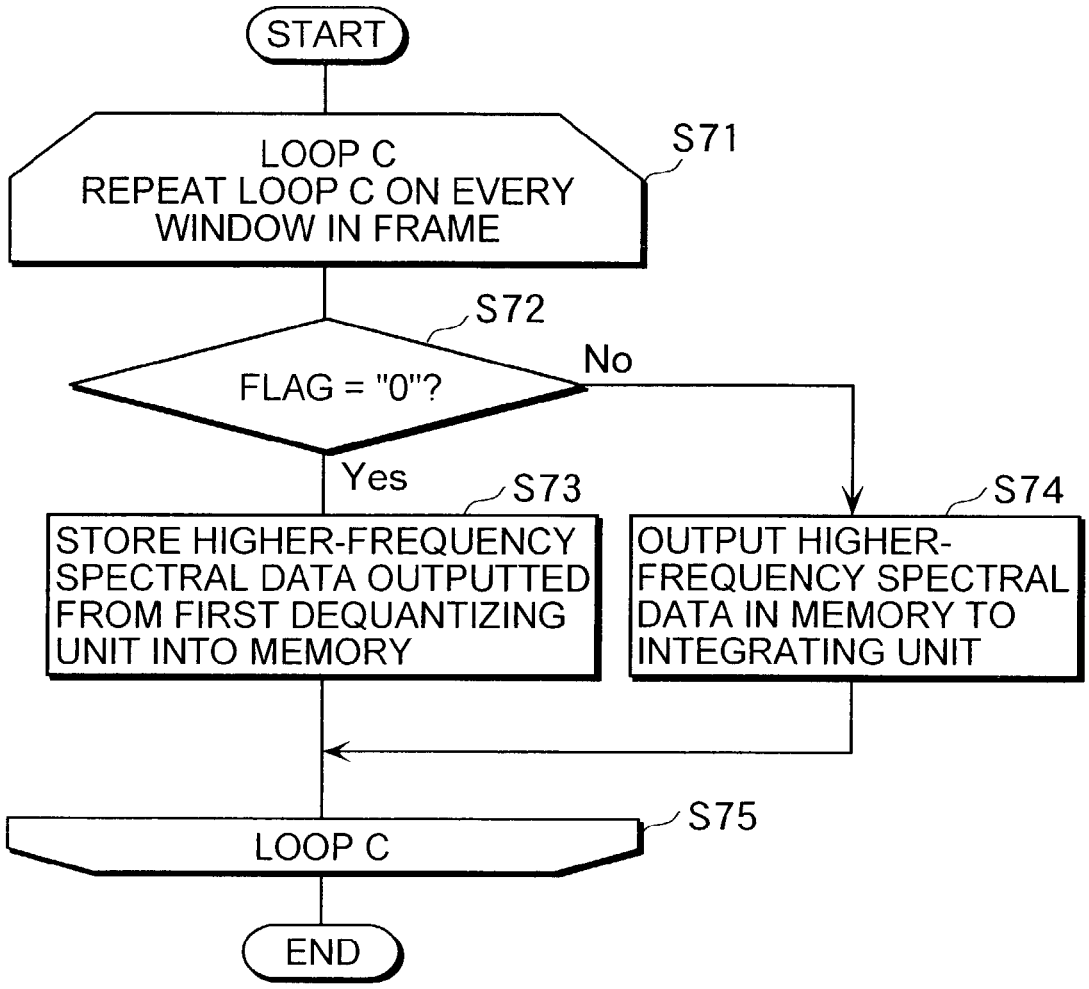
FIG. 9 is a flowchart showing an example operation performed by a second dequantizing unit shown in FIG. 2 to duplicate higher-frequency spectral data.

FIG. 9 is a flowchart showing the operation performed by the second dequantizing unit 224 to duplicate higher-frequency spectral data. The second dequantizing unit 224 is assumed here to have memory capable of storing at least higher-frequency spectral data composed of 64 samples. The second dequantizing unit 224 performs a loop C on each window within a frame (step S71). That is to say, the second dequantizing unit 224 refers to the flag of the window. When the flag is shown as "0" (step S72), the second dequantizing unit 224 stores, into the above memory, higher-frequency spectral data outputted from the first dequantizing unit 222 (step S73). When the flag is not shown as "0" (step S72), the second dequantizing unit 224 outputs the higher-frequency spectral data stored in the memory to the integrating unit 225 (step S74). The above steps of the loop C are repeated for every window within the frame (step S75).

In more detail, the second dequantizing unit 224 receives sharing information decoded by the second decoding unit 223, and refers to a bit, which corresponds to a window that is currently focused on, of the sharing information to judge whether the bit, that is, the flag is shown as "0" (step S72). If so, which means that values of higher-frequency spectral data of the current window are not replaced with "0", the second dequantizing unit 224 stores, into the above memory, the higher-frequency spectral data outputted from the first dequantizing unit 222 (step S73). If the memory has stored other data at this point, the second dequantizing unit 224 updates the memory. On the other hand, when the second dequantizing unit 224 judges that the flag is not shown as "0" (step S72), this indicates that the higher-frequency spectral data outputted from the first dequantizing unit 222 is composed of "0" values. The second dequantizing unit 224 then reads the spectral data from the memory and outputs the read spectral data, as data corresponding to the current window, to the integrating unit 225 (step S74). Consequently in the integrating unit 225, the read higher-frequency spectral data replaces higher-frequency spectral data, which is outputted from the first dequantizing unit 222, of the current window.

For instance, assume that the first window is currently focused on and that the first bit (i.e., flag), which corresponds to the first window, of the sharing information is shown as "0". The second dequantizing unit 224 then writes higher-frequency spectral data in the first window sent from the first dequantizing unit 222 into the memory so that the memory is updated (step S73). In this case, the second dequantizing unit 224 does not output this spectral data to the integrating unit 225, so that spectral data outputted by the first dequantizing unit 222 is outputted to the integrating unit 225 and then to the inverse-transforming unit 230.

After operation on the first window, the second window is focused on. Here, assume that the second bit (i.e., the flag) of the sharing information is shown a "1". The second dequantizing unit 224 then reads higher-frequency spectral data of the first window from the memory, and outputs the read spectral data, as higher-frequency spectral data corresponding to the second window, to the integrating unit 225 (step S74). On the other hand, the first dequantizing unit 222 has outputted spectral data of the second window to the integrating unit 225. This spectral data includes "0" values in its higher frequency band. This higher-frequency spectral data of the value "0" is change by the integrating unit 225 to the above spectral data that was originally included in the first window and that has been read by the second dequantizing unit 224 from the memory.

Based on the sharing information from the encoding device 100, the decoding device 200 thus duplicates higher-frequency spectral data within a window with its flag shown as "0" and uses the duplicated spectral data as higher-frequency spectral data for a window with its flag shown as "1".

After such duplication, it is also possible to adjust the amplitude of the duplicated spectral data as necessary, although in the above example such adjustment is not performed. This adjustment may be made by multiplying each duplicated spectral value by a predetermined coefficient, "0.5", for instance. This coefficient may be a fixed value or be changed in accordance with either a frequency band or spectral data outputted from the first dequantizing unit 222.

The above coefficient may be calculated beforehand by the encoding device 100 and added to the second encoded signal containing the sharing information. As the above coefficient, either a scale factor or a value of quantized data may be added to the second encoded signal. The method for adjusting the amplitude is not limited to the above, and other adjusting methods may be alternatively used.

In the above embodiment, higher-frequency spectral data in a window with its flag shown as "0" is quantized, encoded, and transmitted with the conventional method although other embodiments are alternatively possible. For instance, such higher-frequency spectral data corresponding to the flag shown as "0" may not be transmitted at all, which is to say, all the values of the higher-frequency spectral data may be replaced with "0". Instead, sub information is generated for higher-frequency spectral data in windows with a flag shown as "0", and encoded to be placed into the second encoded signal together with the encoded sharing information. This sub information represents an audio signal in the higher frequency band and may contain representative values of this audio signal. For instance, this sub information may indicate one of the following information.

(1) Scale factors that are provided for scale factor bands in the higher frequency band and that each produce quantized data taking the value "1" from spectral data that has the highest absolute value in each scale factor band in the higher frequency band.

(2) Values of quantized data that are generated by quantizing higher-frequency spectral data having the highest absolute value in each scale factor band in accordance with a predetermined scale factor common to all the scale factor bands.

(3) A location of either: (a) spectral data that has the highest absolute value in each scale factor band; or (b) spectral data that has the highest absolute value in each higher frequency band.

(4) A plus/minus sign of a value of spectral data in a predetermined location in the higher frequency band.

(5) A duplicating method used for duplicating spectral data in the lower frequency band to represent higher-frequency spectral data when these two sets of spectral are similar to each other.

Two or more of the above information (1)~(5) may be combined to produce the sub information. The decoding device 200 reconstructs higher-frequency spectral data in accordance with such sub information.

The following describes the case in which the above scale factors described in (1) are used as sub information.

FIG. 10 shows a specific example of a waveform of spectral data from which the sub information (i.e., scale factors) corresponding to a window based on short blocks is generated. In this figure, boundaries between scale factor bands are represented by tick marks on the frequency axis in the lower frequency band and by vertical dotted lines in the higher frequency band. These boundaries, however, are simplified for ease of explanation, and therefore their actual locations are different from those shown in the figure.

Out of spectral data outputted from the transforming unit 120, lower-frequency spectral data, which is represented by a wave of a solid line, is outputted to the first quantizing unit 131 to be quantized in a conventional manner. On the other hand, higher-frequency spectral data, which is represented by a wave of a dotted line, is expressed as the sub information (i.e., scale factors) calculated by the judging unit 137. The following describes a procedure by which the judging unit 137 generates this sub information with reference to a flowchart of FIG. 11.

The judging unit 137 calculates scale factors for all the scale factor bands in the higher frequency band from 11.025 kHz to 22.05 kHz (step S11). Each scale factor produces quantized data taking the value "1" from spectral data that has the highest absolute value in each scale factor band.

The judging unit 137 specifies spectral data (i.e., a peak) that has the highest absolute value in a scale factor band at the start of the higher frequency band that starts with a frequency higher than 11.025 kHz (step S12). Here, assume that the location of the specified peak is as indicated by ① in FIG. 10 and that the peak value is "256".

The judging unit 137 then substitutes the peak value "256" and the initial scale factor value into a predetermined formula in a similar manner to the procedure shown in FIG. 7 so as to calculate a scale factor that produces quantized data whose value is "1" (step S13). As a result, the judging unit 137 calculates a scale factor "24", for instance. After this, the judging unit 137 specifies a peak of spectral data in the next scale factor band (step S12). Here, assume that the judging unit 137 specifies a peak in the location indicated by ② in the figure and that peak value is "312". The judging unit 137 then calculates a scale factor "32", for instance, that quantizes the peak value "312" to produce the quantized data having the value "1" (step S13).

Similarly for the third scale factor band, the judging unit 137 calculates a scale factor of, for instance, "26" that quantizes the peak value "288" indicated by ③ to produce the quantized data having the value "1". For the fourth scale factor band, the judging unit 137 calculates a scale factor of, for instance, "18" that quantizes the peak value "203" indicated by ④ to produce the quantized data having the value "1".

When scale factors for all the scale factor bands in the higher frequency band are calculated in this way (step S14), the judging unit 137 outputs the calculated scale factors as sub information for higher-frequency spectral data to the second encoding unit 134, and completes the operation.

In this sub information, higher-frequency spectral data in each scale factor band is represented by a single scale factor. When each scale factor value in the higher frequency band is represented by one of values from "0" to "255", the scale factor (whose total number is four in the example of the figure) can be represented by eight bits. If differences between these scale factors are Huffman-encoded, their bit amount can be significantly reduced. Although such sub information only indicates a scale factor for each scale factor band in the higher frequency band, the use of such sub information significantly reduces the amount of spectral data when compared with the conventional method, with which a number of sets of higher-frequency spectral data are quantized so that the same many number of sets of quantized data are generated.

Such higher-frequency spectral data is reconstructed by the decoding device 200 as follows. The decoding device 200 generates either sets of higher-frequency spectral data that have the fixed value or a duplication of each set of spectral data in the lower frequency band. The decoding device 200 then multiplies either the generated sets of spectral data or duplications by the above scale factors to reconstruct the higher-frequency spectral data. As the above scale factor values (as shown in FIG. 10) are almost proportional to peak values in scale factor bands, the spectral data reconstructed by the decoding device 200 is approximately similar to spectral data produced directly from the audio signal inputted to the encoding device 100.

As another method, it is possible to specify a ratio between:(a) the highest absolute value of higher-frequency spectral data that is either composed of the above fixed values or duplications of spectral data in the lower frequency band; and (b) the highest absolute value of higher-frequency spectral data in each scale factor band produced by dequantizing quantized data having the value "1" by using a scale factor for the scale factor band. The decoding device 200 then uses the specified ratio as a coefficient that multiplies the higher-frequency spectral data in each scale factor band, so that the spectral data is reconstructed with higher accuracy.

In the same way as stated above, the higher-frequency spectral data can be reconstructed from the sub information of (2), that is, quantized data generated by quantizing spectral data having the highest absolute value in each scale factor band.

The operation described below is performed by the decoding device 200 when the sub information is the one of the aforementioned information (3) and (4), that is, one of: (a) either a location of spectral data that has the highest absolute value in each scale factor band or a location of spectral data having the highest absolute value in the higher frequency band; and (b) a plus/minus sign of a value of a set of spectral data that exists in a predetermined location within the higher frequency band. The decoding device 200 either generates a spectrum with a predetermined waveform or duplicates a spectrum in the lower frequency band. The decoding device 200 then adjusts the generated/duplicated spectrum so that it has a waveform represented by the sub information (3) or (4).

When the sub information is the above information (5), that is, a duplication method used for duplicating spectral data in the lower frequency band to represent higher-frequency spectral data when these two sets of spectral data are similar to each other, the judging unit 137 operates as follows. In the manner similar to that in which similar spectrums in different windows are specified, the judging unit 137 specifies a scale factor band in the lower frequency band which includes a spectrum similar to a spectrum in the higher frequency band. The specified scale factor band is given a number, and such number is used as part of the sub information.

When the lower-frequency spectrum is duplicated as described above to produce the higher frequency spectrum, the duplication can be performed in one of two directions, that is, from the lower frequency part to the higher frequency part, and vice versa. This duplication direction may be also added to the sub information (5). Moreover, the duplication can be performed with or without a sign of the original lower-frequency spectrum inverted. Such sign of the duplicated spectrum may be also added to the sub information (5), so that the decoding device 200 reconstructs a higher-frequency spectrum in each scale factor band by duplicating a lower-frequency spectrum as indicated by the sub information (5). As the difference between the reconstructed higher-frequency spectrum and its original spectrum is less likely to appear as sound difference when compared with the difference in the lower frequency band, the sub information (5) sufficiently represents the waveform of a higher-frequency spectrum.

In the above embodiment, the judging unit 137 calculates a scale factor that quantizes higher-frequency spectral data to produce quantized data with the value "1". However, this value of the quantized data may not be "1" and may be another predetermined value.

In the above embodiment, only scale factors are encoded as the sub information. It is also possible, however, to encode other information as the sub information, such as quantized data, information on locations of characteristic spectrums, information on plus/minus signs of spectrums, and a method for generating noise. Such different types of information may be combined together as the sub information to be encoded. It would be more effective to combine information, such as a coefficient representing an amplitude ratio and a location of spectral data having the highest absolute value, with the above scale factors that produces, from the highest absolute value of spectral data, quantized data having a predetermined value, and to use the combined information as the sub information to be encoded.

The above embodiment states that the judging unit 137 produces the sharing information, although it is not necessary. When the present encoding device 100 does not produce the sharing information, the second encoding unit 134 becomes unnecessary, but the decoding device 200 is required to specify windows that share the same higher-frequency spectral data. In order to do so, the second dequantizing unit 224 includes memory for storing at least higher-frequency spectral data corresponding to a window. For example, as soon as the first dequantizing unit 222 finishes dequantizing spectral data in each window, the second dequantizing unit 224 places 64 samples of higher-frequency dequantized spectral data whose value is not "0" into the memory. At the same time, the second dequantizing unit 224 detects, from windows outputted from the first dequantizing unit 222, a window that includes higher-frequency spectral data whose values are all "0", associates the detected window with the higher-frequency spectral data stored in the memory, and outputs the stored spectral data. For instance, the second dequantizing unit 224 associates the higher-frequency spectral data stored in the memory with the detected window by sending a number specifying the detected window to the integrating unit 225 when outputting the stored spectral data to the integrating unit 225. In the integrating unit 225, the higher-frequency spectral data within the window specified by the sent number is replaced with the duplication of the higher-frequency spectral data stored in the memory.

When the above operation is performed, it is not necessary for the encoding device 100 to send higher-frequency spectral data within the first window of a frame. In this case, the encoding device 100 places, into the first half of the frame, windows whose higher-frequency spectral data is to be transmitted to the decoding device 200. The second dequantizing unit 224, which always monitors the dequantized result of the first dequantizing unit 222, then specifies that values of the higher-frequency spectral data in the first window are all "0". The second dequantizing unit 224 then searches subsequent windows for a window that includes higher-frequency spectral data whose values are not "0". On finding such window, the second dequantizing unit 224 outputs higher-frequency spectral data in the found window to the integrating unit 225. When doing so, the second dequantizing unit 224 also duplicates this higher-frequency spectral data, stores the duplicated spectral data in the memory. The second dequantizing unit 224 thereafter associates this duplicated spectral data with a window thereafter detected as including higher-frequency spectral data whose values are all "0", and outputs the duplication to the integrating unit 225 so that the spectral data with values "0" are replaced with values of the duplication.

The conventional techniques often omit transmitting higher-frequency spectral data when a transmission channel with a low transfer rate is used. However, the encoding device 100 of the above embodiment transmits higher-frequency spectral data corresponding to at least one window out of eight windows based on short blocks. This enables the decoding device 200 to reproduce an audio signal at high quality in the higher frequency band as well. Moreover, with the present encoding device 100, higher-frequency spectral data is shared by different windows that have similar spectrums. As a result, sound similar to the original sound can be reproduced also for windows whose higher-frequency spectral data is not transmitted to the decoding device 200.

The above embodiment describes the sampling frequency as 44.1 kHz, although it is not limited to 44.1 kHz and may be another frequency. The above embodiment states that the higher frequency band starts with 11.025 kHz although the boundary between high and low frequency bands may not be 11.025 kHz and may be set at another frequency.

In the above embodiment, the ID information is attached to the sharing information and the like, which is included in the second encoded signal placed in the audio bit stream. However, it is not necessary to add this ID information to the sharing information when a region in the bit stream, such as Fill Element or DSE, only stores information encoded by the present encoding device 100 or when the audio bit stream containing the second encoded signal can be decoded only by the decoding device 200 of the present invention. In this case, the decoding device 200 always extracts the second encoded signal from a region (such as Fill Element) determined for both the encoding device 100 and the decoding device 200, and decodes the sharing information.

The above embodiment only describes the case where short blocks are used as units of MDCT conversion. However, when long blocks are used as MDCT block length, it is possible to switch functions of the present encoding device 100 and the decoding device 200 accordingly as in the conventional encoding device 300 and decoding device 400. More specifically, units within the encoding device 100 and the decoding device 200 are switched to operate as follows. The audio signal input unit 110 extracts 1,024 samples, and additionally extracts two sets of 512 samples, with one of the two sets of 512 samples overlapping with part of 1,024 samples previously extracted and the other set of 512 samples overlapping with part of 1,024 samples to be extracted next. The transforming unit 120 performs MDCT conversion on 2,048 samples at a time to produce spectral data composed of 2,048 samples, half (i.e., 1,024 samples) of which is then divided into predetermined 49 scale factor bands. The judging unit 137 receives the produced spectral data from the transforming unit 120, and outputs it as it is to the first quantizing unit 131. The second encoding unit 134 temporarily stops its operation. The stream input unit 210 of the decoding device 200 does not extract the second encoded signal from the encoded audio bit stream, and the second decoding unit 223 and the second dequantizing unit 224 temporarily stop their operations. The integrating unit 225 receives the spectral data from the first dequantizing unit 222, and outputs the received data as it is to the invert-transforming unit 230.

With this switching function of the encoding device 100 and the decoding device 200, a tune with a slow tempo, for instance, can be transmitted and decoded based on long blocks that provide high sound quality, while a tune with a quick tempo, which frequently produces attacks, can be transmitted and decoded based on short blocks that provide better time resolution.

Second Embodiment

Figure 12:
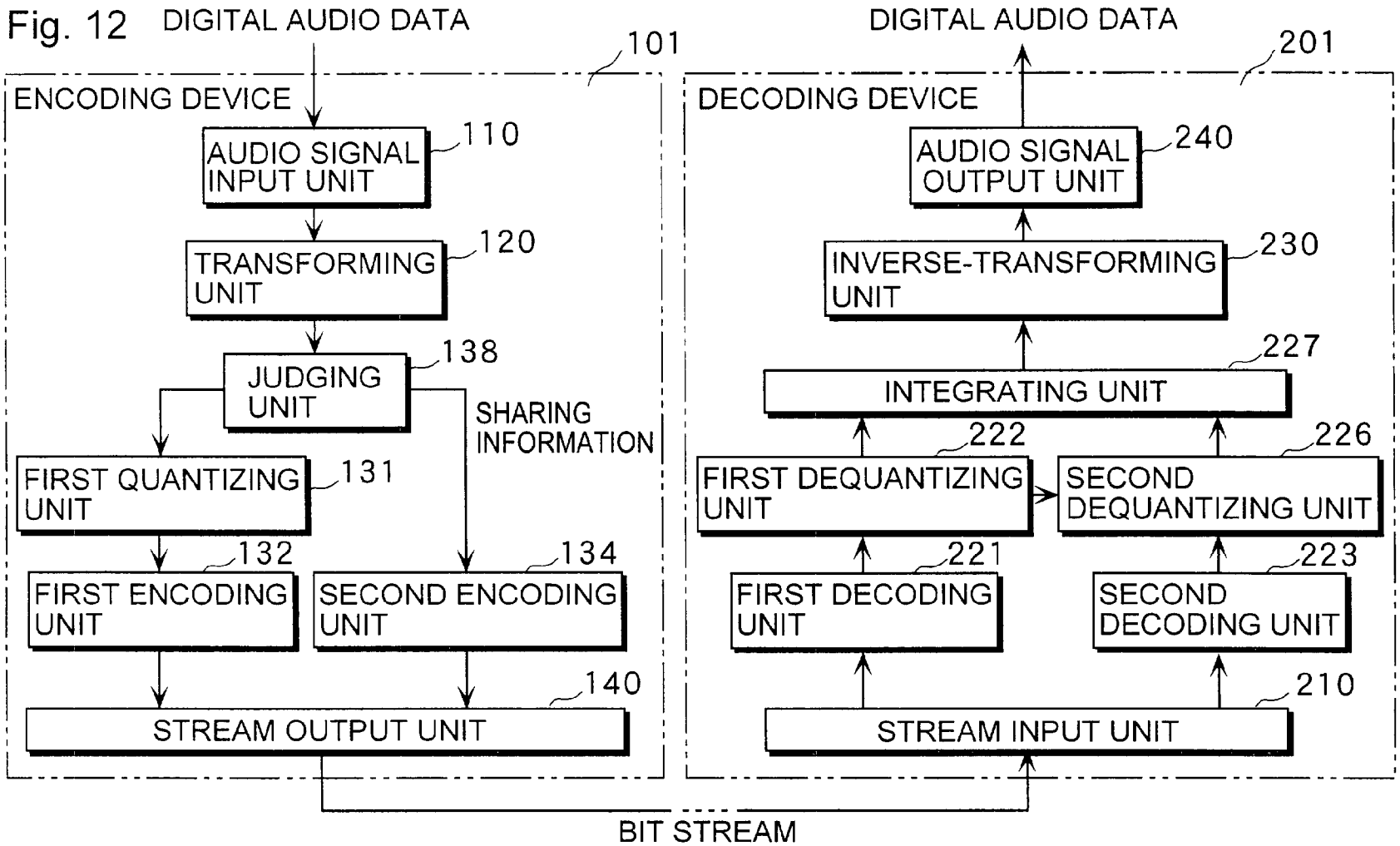
FIG. 12 is a block diagram showing constructions of an encoding device and a decoding device of the second embodiment of the present invention.
Figure 13:
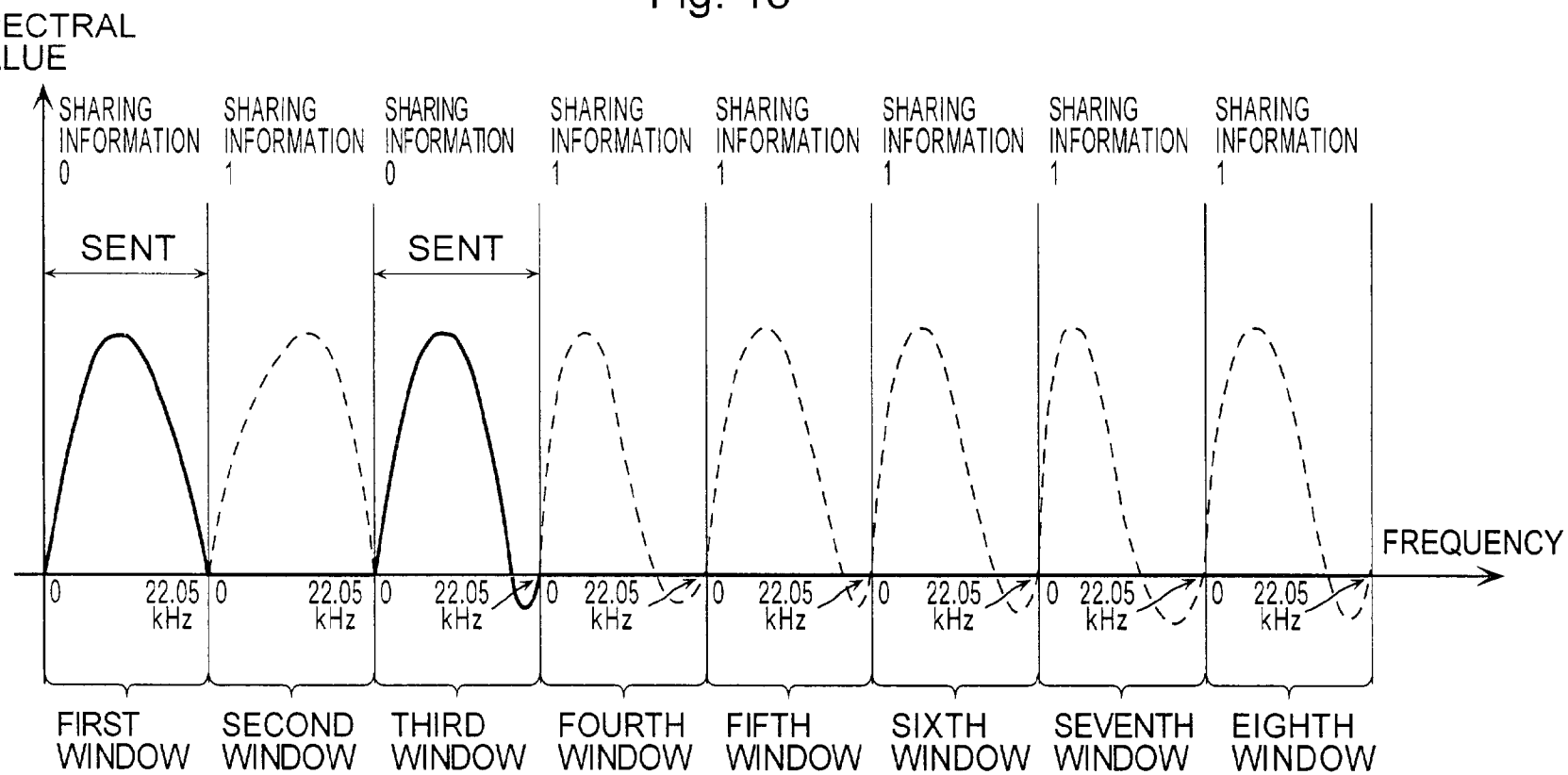
FIG. 13 shows an example of how a judging unit shown in FIG. 12 judges spectral data as being represented by other spectral data.

The following describes an encoding device 101 and a decoding device 201 of the second embodiment with reference to FIGS. 12 and 13 while focusing on features that are different from the first embodiment. FIG. 12 is a block diagram showing constructions of the encoding device 101 and the decoding device 201.

Encoding Device 101

When short blocks are used as MDCT block length, the encoding device 101 specifies two or more windows that include sets of spectral data that are similar to one another. The encoding device 101 then has a set of spectral data within one of the specified windows represent other sets of spectral data within other specified windows. In the present embodiment, a set of spectral data represents other sets of spectral data in a full frequency range. The encoding device 101 thus reduces the bit amount of the encoded audio bit stream. The encoding device 101 includes an audio signal input unit 110, a transforming unit 120, a first quantizing unit 131, a first encoding unit 132, a second encoding unit 134, a judging unit 138, and a stream output unit 140.

The judging unit 138 differs from the judging unit 137 of the first embodiment in that the present unit 138 judges whether spectral data within one window represents different spectral data within other windows in the full frequency band, including the lower frequency band as well as the higher frequency band. That is to say, the present embodiment reduces the data amount of an audio signal in the lower frequency band, for which higher accuracy is required for reproducing the original sound than for the higher frequency band. In more detail, the judging unit 138 focuses on each of eight windows including spectral data outputted from the transforming unit 120, and judges whether spectral data within the focused-on window can be represented by another spectral data within another window out of the eight windows. On judging that the spectral data can be represented by another spectral data, the judging unit 138 changes all the values of spectral data in the focused-on window to "0", and generates the sharing information described above.

For instance, assume that the judging unit 138 judges that spectral data in the second window can be represented by spectral data in the first window and that spectral data in windows from the fourth to eighth windows can be represented by spectral data in the third window. The judging unit 138 then changes all the values of spectral data in the second window and windows from the fourth to eighth to "0", and outputs the sharing information shown as "01011111". As a result, the first quantizing unit 131 quantizes spectral data that has a much smaller bit amount than conventional spectral data because all the values of spectral data within the second window and windows from the fourth to eighth are "0".

Decoding Device 201

The decoding device 201 decodes the audio bit stream encoded by the encoding device 101, and comprises a stream input unit 210, a first decoding unit 221, a first dequantizing unit 222, a second decoding unit 223, a second dequantizing unit 226, an integrating unit 227, an inverse-transforming unit 230, and an audio signal output unit 240.

The second dequantizing unit 226 refers to the sharing information decoded by the second decoding unit 223. For a window whose sharing information (i.e., a flag) is shown as "0", the second dequantizing unit 226 duplicates spectral data that has been dequantized by the first dequantizing unit 222, and places the duplicated spectral data into the memory. After this, the second dequantizing unit 226 associates this duplication with a subsequent window whose flag is shown as "1", and outputs the duplication to the integrating unit 227.

The integrating unit 227 integrates spectral data outputted from the first dequantizing unit 222 with spectral data outputted from the second dequantizing unit 226. This integration is performed in units of windows.

FIG. 13 shows an example of how the judging unit 138 makes a judgment about a single set of spectral data representing different sets of spectral data. This figure shows spectral data generated through MDCT conversion based on short blocks as shown in FIG. 3B. When the sampling frequency for the input audio signal is 44.1 kHz, for instance, the reproduction frequency band in each window ranges from 0 kHz to 22.05 kHz as shown in the figure.

As described earlier, two spectrums included in adjacent two windows are likely to take a similar waveform when the windows are generated based on short blocks because these windows are extracted in short cycles. When judging that spectrums in the first and second windows are similar to each other and that spectrums in windows from the third window to the eighth window are similar to one another, the judging unit 138 judges that spectral data in the second window can be represented by spectral data in the first window and that spectral data in windows from the fourth to eighth windows can be represented by spectral data in the third window. In this case, spectral data represented in a waveform of a solid line in the figure is quantized and encoded to be transmitted to the decoding device 201, and values of other spectral data in other windows, that is, the second window and windows from the third to the eighth, are replaced with "0". When the decoding device 201 receives spectral data whose values are all "0", the decoding device 201 duplicates spectral data in a preceding window with the flag shown as "0" and uses the duplication as a reconstructed form of the received spectral data.

The data amount of the encoded audio bit stream is drastically reduced when spectral data in the lower frequency band as well as the higher frequency band is shared between different windows containing similar spectrums. However, human hearing is very sensitive to an audio signal in the lower frequency band, and therefore the judging unit 138 is required to make more accurate judgment about the similarity of spectrums than in the first embodiment. More specifically, the judging unit 138 uses basically the same judging method as the judging unit 137 of the first embodiment, but the present judging unit 138 uses a lower threshold value for the judgment and/or uses a plurality of judging methods so as to make highly accurate judgment. Also note that the present encoding device 101 is not allowed to transmit spectral data within predetermined windows alone to the decoding device 201 without similarity judgment by the judging unit 137 because the similarity judgment cannot be omitted from the present embodiment for the stated reason.

It is not necessary for the judging unit 138 to generate the sharing information, as with the judging unit 137. In this case, the second encoding unit 134 is unnecessary. This can be achieved, for instance, as follows. The judging unit 138 specifies windows containing similar spectrums and puts them under the same group. The judging unit 138 then generates information relating to this grouping, and outputs the generated information to the first quantizing unit 131. Spectral data in at least one window within such group is quantized, encoded, and transmitted to the decoding device 201 as with the conventional technique. On the other hand, values of other spectral data in windows other than the at least one window under the same group are replaced with "0". Note that it is not necessary for spectral data within a window at the start of each group to represent other spectral data in other windows within the same group. Also it is not necessary for spectral data in a single window to represent other spectral data in other windows under the same group.

The above grouping is conventionally performed for short blocks by using a conventional tool, and therefore only briefly described. Through this grouping, windows containing similar spectrums are grouped under the same group, and these windows under the same group share the same scale factor. Similarity judgment for the grouping is performed like the above similarity judgment on spectral data shared between windows. When the sampling frequency is 44.1 kHz and short blocks are used, each window is conventionally defined as containing 14 scale factor bands, and therefore 14 scale factors exist within each window. Accordingly, when more windows are grouped under the same group, the bit amount of the scale factors to be transmitted becomes smaller.

It is alternatively possible for the judging unit 138 to calculate an average of spectral values of the same frequency within different windows under the same group if these windows have spectrums sufficiently similar to one another. The judging unit 138 calculates such average spectral value for each frequency, generates a new window composed of 128 average spectral values in the full frequencies, and uses the generated new window as a representing window at the start of a frame. (It is not necessary to place this representing window at the start of the frame.) The judging unit 138 then changes spectral values in other windows under the same group to "0", and outputs these windows to the first quantizing unit 131.

When the encoding device 101 does not generate sharing information, the following operation is also possible. For the encoding device 101 and the decoding device 201, it is decided beforehand that the encoding device 101 only quantizes, encodes, and transmits spectral data in a window at the start of each group. As for spectral data in other windows under the same group, it is decided that the encoding device 101 changes their spectral values to "0" to transmit them to the decoding device 201. The second dequantizing unit 226 of the decoding device 201 duplicates spectral data in the window at the start of each group while referring to decoded information regarding the grouping, associates the duplicated spectral data with each window that follows the first window in the same group, and outputs it to the dequantizing unit 227, which then performs integration.

When the encoding device 101 does not generate sharing information and the first window can be composed of values replaced with "0", the following operation may be performed. In accordance with the information relating to the grouping, the second dequantizing unit 226 of the decoding device 201 monitors dequantized spectral data outputted from the first dequantizing unit 222. On detecting that spectral data outputted from the first dequantizing unit 222 takes the value "0", the second dequantizing unit 226 searches spectral data having the same frequency as the detected spectral data in other windows under the same group to find spectral data having a value other than "0". The second dequantizing unit 226 then duplicates the value of the found spectral data, and outputs it to the integrating unit 227, which then performs integration.

The following operation may be alternatively performed. When values of spectral data within a window dequantized by the first dequantizing unit 222 are all "0", the second dequantizing unit 226 searches other windows within the same group to find a window including spectral data whose values are not "0". On finding such window, the second dequantizing unit 226 duplicates spectral data in the found window, associates the duplicated spectral data with the above spectral data taking "0" values, and outputs the duplicated spectral data to the integrating unit 227.

Windows grouped together by the judging unit 138 may include a plurality of windows containing spectral data whose values are not replaced with "0", and such group of windows may be outputted to the first quantizing unit 131. In this case, the second dequantizing unit 226 of the decoding device 201 detects spectral data taking the "0" value as a result of dequantization by the first dequantizing unit 222, searches other windows under the same group to find certain spectral data that has the same frequency as the detected spectral data and whose value is not "0". The above "certain spectral data" is one of the following: (a) spectral data that is first found through the above search; (b) spectral data that has the highest value in the searched windows; and (c) spectral data that has the lowest value in the searched windows. The second dequantizing unit 226 then duplicates the found certain spectral data.

When windows grouped together by the judging unit 138 includes a plurality of windows containing spectral data whose values are not replaced with "0" as described above, the following operation is also possible. After the second dequantizing unit 226 of the decoding device 201 detects spectral data taking the "0" value as a result of dequantization by the first dequantizing unit 222, the second dequantizing unit 226 searches other windows that do not include spectral data of the values "0" under the same group to find one of the following windows: (a) a window that includes the highest peak of spectral data among the searched windows; and (b) a window whose energy is the largest among the searched windows. The second dequantizing unit 226 then duplicates all the spectral data in the found window.

With the present embodiment, when different windows out of eight windows include spectrums similar to one another, these different windows share the same spectral data. This can minimize the data amount of the encoded audio bit stream while minimizing degradation in quality of the reconstructed spectral data.

It is of course possible to adjust the amplitude of spectral data duplicated by the second dequantizing unit 226 as necessary. This adjustment may be made by multiplying each spectral value by a predetermined coefficient, such as "0.5". This coefficient may be a fixed value or be changed in accordance with either a frequency band or spectral data outputted from the first dequantizing unit 222. This coefficient may not be a predetermined value. For instance, the coefficient may be added as the sub information to the second encoded signal. Either a scale factor value or a quantized value of quantized data may be used as the coefficient and added to the second encoded signal.

It is also possible in the present embodiment to replace values of higher-frequency spectral data within a window whose flag is shown as "0" with "0" and instead generate sub information for the higher-frequency spectral data, as described in the first embodiment. In this case, the second encoded signal includes the sub information as well as the sharing information. That is to say, for spectral data within a window with the flag shown as "0", the encoding device 102 quantizes and encodes lower-frequency spectral data alone as conventionally performed. The encoding device 101 regards higher-frequency spectral data in the above window as "0", quantizes and encodes it, and generates the sub information relating to the higher-frequency spectral data, as in the first embodiment. The encoding device 101 then encodes the sub information together with the sharing information. When receiving the window whose flag is shown as "0", the decoding device 201 reconstructs the lower-frequency spectral data by dequantizing the first encoded signal in the same manner as described earlier, and reconstructs the higher-frequency spectral data in accordance with the sub information. For reconstructing spectral data in a window whose flag is shown as "1", the decoding device 201 duplicates the above reconstructed spectral data across the full frequency range within the window with the flag shown as "0".

Third Embodiment

Figure 14:
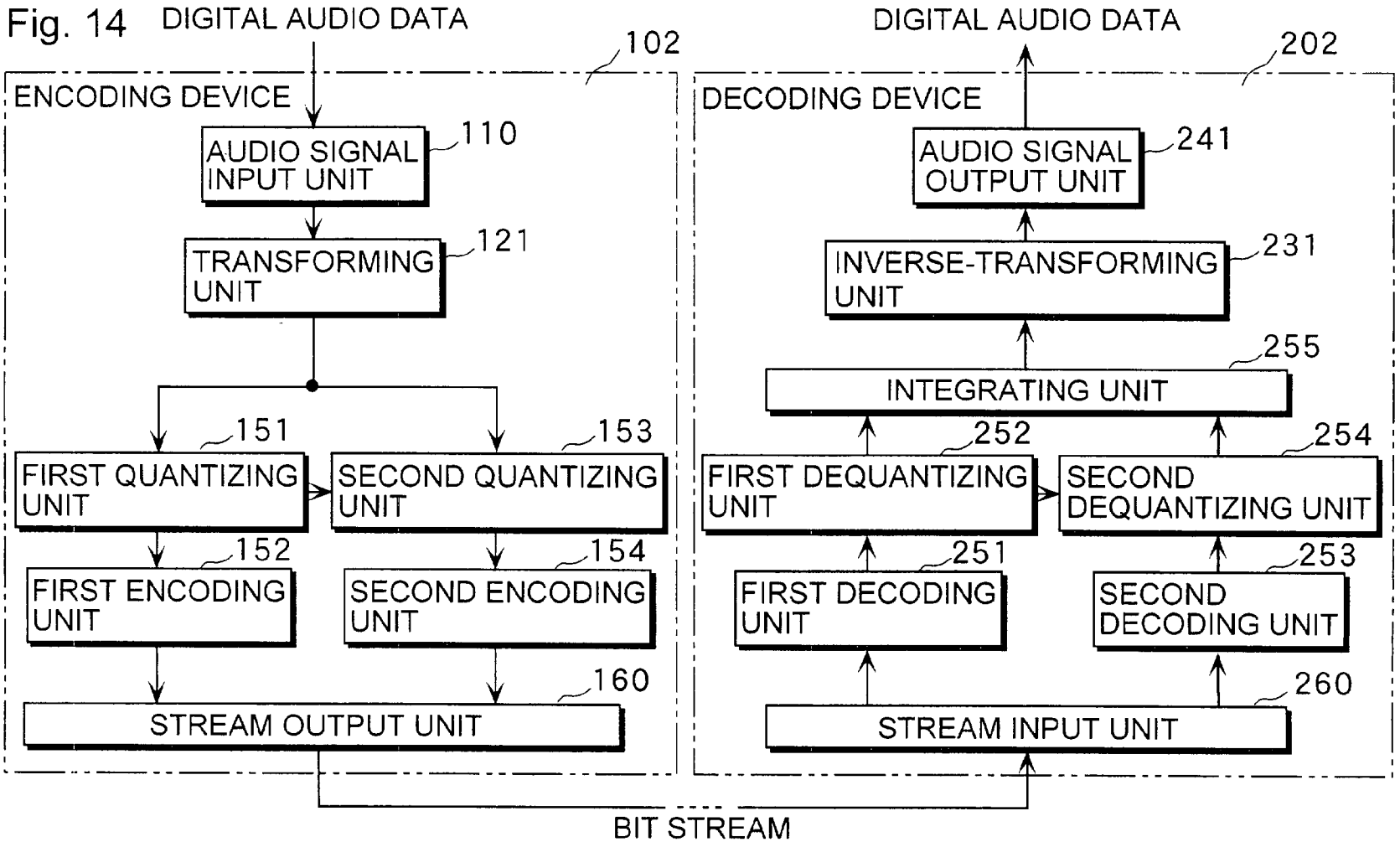
FIG. 14 is a block diagram showing constructions of an encoding device and a decoding device of the third embodiment of the present invention.

The following describes an encoding device 102 and a decoding device 202 of the third embodiment with reference to FIGS. 14~17 with focus on features of the present embodiment that are different from the first embodiment. FIG. 14 is a block diagram showing constructions of the encoding device 102 and the decoding device 202.

Encoding Device 102

This encoding device 102 reconstructs spectral data, from which quantized data of the value "0" is generated, because this spectral data is adjacent to spectral data that has the highest absolute value. Spectral data processed by the encoding device 102 is based on long blocks. The reconstructed spectral data is then represented by data of a smaller bit amount to be transmitted to the decoding device 202. The encoding device 102 comprises an audio signal input unit 111, a transforming unit 121, a first quantizing unit 151, a first encoding unit 152, a second quantizing unit 153, a second encoding unit 154, and a stream output unit 160.

The audio signal input unit 111 receives digital audio data, such as audio data based on MPEG-2 AAC, sampled at a sampling frequency of 44.1 kHz. From this digital audio data, the audio signal input unit 110 extracts consecutive 1,024 samples in a cycle of 23.2 msec. The audio signal input unit 110 additionally obtains two sets of 512 samples, with one of the two sets of 512 samples overlapping with part of 1,024 samples previously extracted and the other set of 512 samples overlapping with part of 1,024 samples to be extracted next. Consequently, the audio signal input unit 110 obtains 2,048 samples in total.

The transforming unit 121 receives the 2,048 samples from the audio signal input unit 110, and transforms the 2,048 samples in the time domain into spectral data in the frequency domain in accordance with MDCT conversion. This spectral data is composed of 2,048 samples and takes a symmetrical waveform. Accordingly, only half (i.e., 1,024 samples) of the 2,048 samples are subject to the subsequent operations. The transforming unit 121 then divides these samples into a plurality of groups corresponding to scale factor bands, each of which includes at least one sample (or, practically speaking, samples whose total number is a multiple of four). When the sampling frequency is 44.1 kHz, each frame based on long blocks includes 49 scale factor bands.

The first quantizing unit 151 receives the spectral data from the transforming unit 121, and determines a scale factor for each scale factors band of the spectral data. The first quantizing unit 151 then quantizes spectral data in each scale factor band by using a determined scale factor to produce quantized data, and outputs the quantized data to the first encoding unit 152.

The first encoding unit 152 receives the quantized data and scale factors used for the quantized data, and Huffman-encodes the quantized data, differences in the scale factors, and the like as a first encoded signal in a format used for a predetermined stream.

The second quantizing unit 153 monitors quantized data outputted from the first quantizing unit 151 so as to detect, in each scale factor band, ten samples of quantized data, whose values are "0" because they are produced from spectral data adjacent to spectral data that has the highest absolute value in the scale factor band. These ten samples consist of five samples that immediately precede quantized data produced from spectral data of the highest absolute value and five samples that immediately follow this quantized data. The second quantizing unit 153 then obtains spectral values that correspond to the detected ten samples of quantized data from the transforming unit 121, and quantizes the obtained spectral values by using a scale factor decided beforehand between the encoding device 102 and the decoding device 202 so that quantized data is produced. The second quantizing unit 153 then makes data of a smaller bit amount represent this quantized data, and outputs the quantized data to the second encoding unit 154.

The second encoding unit 154 receives the quantized data, and Huffman-encodes it into a second encoded signal in a predetermined format for the stream. Following this, the second encoding unit 154 outputs the second encoded signal to the stream output unit 160. Note that the scale factor used for quantization by the second quantizing unit 154 is not encoded.

The stream output unit 160 receives the first encoded signal from the first encoding unit 152, adds header information and other necessary secondary information to the first encoded signal, and transforms it into an MPEG-2 AAC bit stream. The stream output unit 160 also receives the second encoded signal from the second encoding unit 154, and places it into a region, which is either ignored by a conventional decoding device or for which no operations are defined, of the above MPEG-2 AAC bit stream.

Decoding Device 202

In accordance with the decoded second encoded signal, the decoding device 202 reconstructs spectral data, from which quantized data with the value "0" is generated because this spectral data is adjacent to spectral data that has the highest absolute value. The decoding device 202 comprises a stream input unit 260, a first decoding unit 251, a first dequantizing unit 252, a second decoding unit 253, a second dequantizing unit 254, an integrating unit 255, an inverse-transforming unit 231, and an audio signal output unit 241.

The stream input unit 260 receives the encoded audio bit stream from the encoding device 102, extracts the first and second encoded signals from the encoded bit stream, and outputs the first and second encoded signals to the first decoding unit 251 and the second decoding unit 253, respectively.

The first decoding unit 251 receives the first encoded signal, that is, Huffman-encoded data in the stream format, and decodes it into quantized data.

The first dequantizing unit 252 receives the quantized data from the first decoding unit 251, and dequantizes it to produce spectral data composed of 1,024 samples with a 22.05-kHz reproduction band.

The second decoding unit 253 receives the second encoded signal from the stream input unit 260, decodes it into quantized data composed of the ten samples produced from ten sample of spectral data that immediately precede and follow spectral data of the highest absolute value. The second decoding unit 253 then outputs the quantized data to the second dequantizing unit 254.

The second dequantizing unit 254 dequantizes the quantized data by using the predetermined scale factor to produce the ten samples of spectral data. The second dequantizing unit 254 refers to spectral data outputted from the first dequantizing unit 252 so as to detect the ten samples that have values "0" because they are adjacent to the spectral value with the highest absolute value. Following this, the second dequantizing unit 254 specifies frequencies of the detected ten samples, associates the produced ten samples with the specified frequencies, and outputs the produced ten samples to the integrating unit 225.

The integrating unit 255 integrates the spectral data outputted from the first and second dequantizing units 252 and 254 together, and outputs the integrated spectral data to the inverse-transforming unit 231. In more detail, in the integrating unit 255, spectral values that are outputted from the first dequantizing unit 252 and that are specified by the above frequencies are replaced with spectral values (the produced ten samples) that are outputted from the second dequantizing unit 254.

The inverse-transforming unit 231 receives the integrated spectral data composed of 1,024 samples from the integrating unit 225, and performs IMDCT on the spectral data in the frequency domain into an audio signal in the time domain.

The audio signal output unit 241 sequentially combines sets of sampled data outputted from the inverse-transforming unit 231 to produce and output digital audio data.

As has been described, the encoding device 102 encodes spectral data immediately preceding and following spectral data having the highest absolute value in each scale factor band by using a scale factor different from that used by the first quantizing unit 151, so that the resulting quantized data takes a value that is not "0", unlike the conventional technique that produces quantized data taking the value "0" from spectral data near the highest absolute value. This produces an encoded signal achieving higher sound quality and enhances reproduction accuracy near the peak across the whole reproduction band.

In the above embodiment, the second quantizing unit 153 quantizes spectral data outputted from the transforming unit 121, although spectral data quantized by the second quantizing unit 153 is not limited to quantized data outputted from the transforming unit 121. For instance, the second quantizing unit 153 may quantize spectral data that is produced by dequantization of quantized data outputted from the first dequantizing unit 151. An encoding device 102 performing this operation is shown in FIG. 15.

Figure 15:
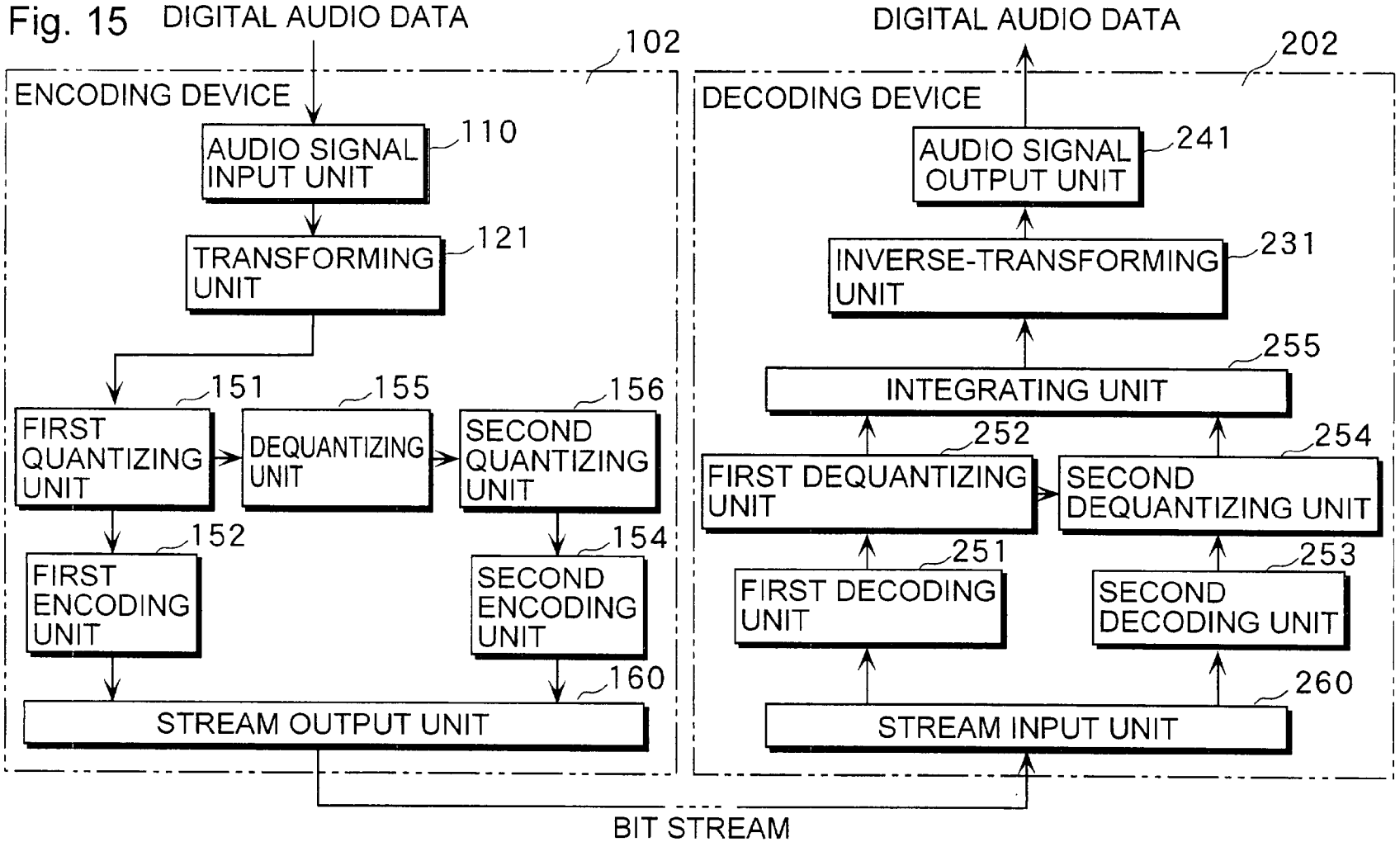
FIG. 15 is a block diagram showing other constructions of an encoding device and a decoding device of the third embodiment.

FIG. 15 is a block diagram showing constructions of this encoding device 102 and a corresponding decoding device 202. The encoding device 102 comprises an audio signal input unit 111, a transforming unit 121, a first quantizing unit 151, a first encoding unit 152, a second quantizing unit 156, a second encoding unit 154, a dequantizing unit 155, and a stream output unit 160.

The second quantizing unit 156 monitors the result of quantization by the first quantizing unit 151 via the dequantizing unit 155 to specify ten samples of spectral data from which quantized data with values "0" is produced because these samples are adjacent to spectral data of the highest absolute value. The second quantizing unit 156 then obtains the specified ten samples of the spectral data from the dequantizing unit 155 and quantizes them by using a predetermined scale factor.

The dequantizing unit 155 dequantizes quantized data outputted from the first quantizing unit 151 to produce spectral data, and outputs the produced spectral data and the original spectral data to the second quantizing unit 156.

The following describes the processing of the above encoding device 102 and the decoding device 202 with reference to FIGS. 16 and 17.

When the first quantizing unit 151 of the encoding device 102 performs, as in the conventional technique, quantization using a scale factor determined so as to make a bit amount of each encoded frame within a range of a transfer rate of a transmission channel, spectral data adjacent to spectral data having the highest absolute value often becomes quantized data that takes values "0". When the decoding device 202 decodes this quantized data, the resulting spectral data also takes values "0" near the spectral data of the highest absolute value that alone is correctly reconstructed. Such spectral data having values "0" causes a quantization error, which degrades the quality of a reproduced audio signal.

When a scale factor is adjusted so as to prevent the spectral data adjacent to the spectral data of the highest absolute value from taking values "0" and then quantization is performed with the adjusted scale factor, the resulting quantized data takes exceedingly high values. This is not desirable, however, especially when an encoded audio bit stream is transmitted via a transmission channel because the bit amount of the encoded audio bit stream is likely to increase in accordance with the maximum value of quantized data.

FIG. 16 is a table 500 showing the difference in results of quantization by the conventional encoding device 300 and the encoding device 102 of the present invention with reference to specific values. With the conventional encoding device 300, the quantizing unit 331 receives, for instance, spectral data 501 including values {10, 40, 100, 30} from the transforming unit 320, and quantizes this spectral data 501 by using a scale factor determined in accordance with a bit amount of a frame of an encoded audio bit stream. As a result, quantized data 502 including values {0, 0, 1, 0}, for instance, is produced. Values of spectral data adjacent to the spectral data of the highest value "100" are transformed into values "0" of quantized data. The conventional encoding device 300 encodes this quantized data 502, which is encoded and transmitted to the decoding device 400. When the dequantizing unit 422 of the decoding device 400 dequantizes the quantized data 502, resulting spectral data 505 takes values {0, 0, 100, 0}.

On the other hand, with the encoding device 102 of the present invention, when the first quantizing unit 151 receives the above spectral data 501 including values {10, 40, 100, 30} from the transforming unit 121, and quantizes the spectral data 501, the resulting quantized data is the same as the above quantized data 502 which includes values {0, 0, 1, 0}. This quantized data 502 is then outputted to the first encoding unit 152 as it is. To supplement this quantized data 502, the present encoding device 102 additionally includes the second quantizing unit 153/156 that quantizes the above spectral data 501 by using a predetermined scale factor. The second quantizing unit 153/156 produces quantized data 503 including values {1, 4, 10, 3}, for instance. Among these values of the quantized data 503, the minimum value is "1", and therefore lowering the present scale factor makes this minimum value "0". Accordingly, this quantized data 503 is composed of the lowest possible values that do not include the values "0" near the highest value, although the maximum value of the quantized data 503 is "10", which is not sufficiently low.

Accordingly, the second quantizing unit 153/156 uses an exponential function or the like for representing the quantized data 503 so as to reduce the bit amount of the quantized data 503. The second quantizing unit 153/156 therefore produces quantized data 504 including values {1, 2, 0, 2}, for instance.

In more detail, the first value "1" in this quantized data 504 represents "2" as the "1"st power of "2", the second value "2" represents "4" as the "2"nd power of "2", and the third value "0" represents that spectral data of the highest absolute value is produced from this quantized value. This spectral data of the highest absolute value can be correctly reconstructed from the first encoded signal that includes a scale factor used in the first quantizing unit 151 and the quantized data of the value "1". As the second encoding unit 154 does not encode the spectral data of the highest absolute value in each scale factor band, the resulting bit amount of the second encoded signal is further reduced. The fourth value "2" in the quantized data 504 represents "4" as the "2"nd power of "2". Although this quantized data 504 including values {1, 2, 0, 2} does not match with the quantized data 503 including values {1, 4, 10, 3}, the quantized data 504 is capable of representing all the values by using only two bits. The decoding device 202 reconstructs spectral data from the quantized data 502 obtained from the first encoded signal and the quantized data 504 obtained from the second encoded signal. As a result, spectral data 505 including values {20, 40, 100, 40} is obtained.

With the above encoding device 102, quantized data outputted from the second quantizing unit 153/156 is represented by data of a smaller bit amount to minimize the bit amount of the second encoded signal. Moreover, spectral data reconstructed by the decoding device 202 is roughly the same as original spectral data even near the peak, although such spectral data near the peak is conventionally reconstructed only as "0" values as a result of reducing the bit amount of encoded data. The present encoding device 102 therefore realizes more accurate reproduction of original sound.

In the above embodiment, quantized data produced by the second quantizing unit 153 is represented by an exponent of the base "2". However, the base is not limited to "2", and may be any other value, including a value other than an integer. It is not necessary to represent the quantized data in the second quantizing unit 153 by using an exponential function, and other function may be used instead.

Figures 17A, 17B, 17C:
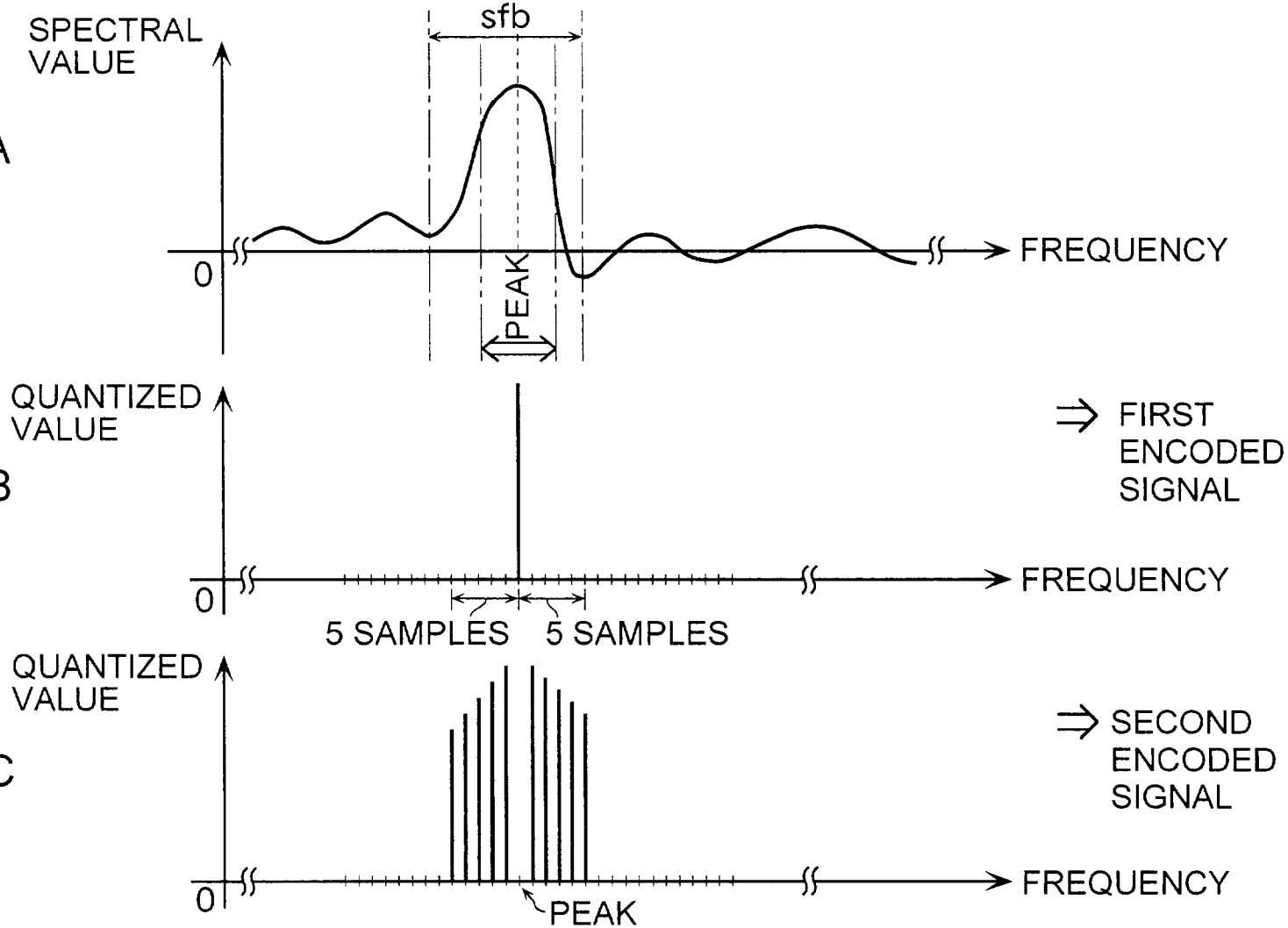
FIGS. 17A, 17B, and 17C show how the encoding device corrects errors in quantized data near the peak as one example.

FIGS. 17A~17C show an example in which the encoding device 102 corrects an error in quantization. FIG. 17A shows a waveform of a part of a spectrum outputted from the transforming unit 121 shown in FIGS. 14 and 15. In FIG. 17A, two outermost vertical dotted lines represent a scale factor band (shown as "sfb"), and the center vertical dotted line within the scale factor band indicates a frequency of spectral data that has the highest absolute value in this scale factor band. This center line is flanked by two dotted lines, which represent a range of ten samples of spectral data adjacent to the spectral data of the highest absolute value. FIG. 17B shows an example of quantized data produced by the first quantizing unit 151 shown in FIGS. 14 and 15 as a result of quantization of the spectral data shown in FIG. 17A. FIG. 17C shows an example of quantized data produced by the second quantizing unit 153/156 shown in FIGS. 14 and 15 as a result of quantization of the spectral data shown in FIG. 17A. In FIGS. 17A~17C, the horizontal axis represents frequencies. The vertical axis shown in FIG. 17A represents spectral values, and the vertical axis shown in FIGS. 17B and 17C represents quantized values of quantized data.

A plurality of sets of spectral data in a scale factor band are normalized and quantized using a scale factor common to the whole scale factor band. When this scale factor is determined in accordance with a bit amount of the entire frame and the highest absolute value of the spectral data is relatively large as shown in FIG. 17A, it is likely that the spectral data of the highest absolute value becomes quantized data having a value other than "0" as shown in FIG. 17B, but other spectral data in the same frequency band often takes the value "0". Such quantized data is outputted from the first quantizing unit 151 to the first encoding unit 152. With the present encoding device 102, quantized data shown in FIG. 17C is also produced by the second quantizing unit 153/156 and transmitted as the second encoded signal to the decoding device 202. That is to say, the second quantizing unit 153/156 produces quantized data having the value "0" from the spectral data of the highest absolute value while the second quantizing unit 153/156 also quantizes ten samples adjacent to this spectral data.

The second quantizing unit 153/156 uses a predetermined scale factor for quantization. When this predetermined scale factor happens to be close to a scale factor used by the first quantizing unit 151, the resulting quantized data is likely to take the value "0" if quantized data produced by the first quantizing unit 151 takes the value "0". Accordingly, a scale factor band appropriate for each scale factor band is determined in advance to be provided to the second quantizing unit 153/156 so as to obtain quantized data with non-zero values as shown in FIG. 17C in more scale factor bands when the quantized data produced by the first quantizing unit 151 takes the values "0".

That is to say, the second quantizing unit 153/156 obtains spectral data, which is quantized by the first quantizing unit 151 as shown in FIG. 17B, from either the transforming unit 121 or the dequantizing unit 155. The second quantizing unit 153/156 then quantizes the obtained spectral data by using a predetermined scale factor to produce quantized data, has the quantized data represented by data of a smaller bit amount, and outputs it to the second encoding unit 154. The second quantizing unit 153/156 therefore minimizes the bit amount of the second encoded signal through the following three measures: (1) Using scale factors and functions determined beforehand for the encoding device 102 and the decoding device 202 so that the scale factors and functions do not need to be encoded; (2) Not quantizing the spectral data of the highest absolute value; and (3) Using a function for representing quantized data produced from ten samples of spectral data adjacent to the spectral data of the highest absolute value.

In the above embodiment, the second quantizing unit 153/156 quantizes two sets of consecutive five samples of spectral data. However, the samples of spectral data quantized by the second quantizing unit 153/156 are not necessarily consecutively arranged if their resulting quantized values "0" are present near a quantized value produced from the spectral data of the highest absolute value. More specifically, the second quantizing unit 153/156 refers to quantization result of the first quantizing unit 151 to specify five samples of spectral data that exist both sides of spectral data having the highest absolute value and from which sets of quantized data with the value "0" are generated. The second quantizing unit 153/156 then quantizes the specified samples of spectral data by using the stated predetermined scale factor to produce quantized data, makes bits of smaller amount represent the quantized data, and outputs the bits to the second encoding unit 154. The second dequantizing unit 254 of the decoding device 202 monitors dequantized spectral data produced by the first dequantizing unit 252, and specifies the above five samples of spectral data with values "0" on both sides of dequantized spectral data of the highest absolute value. The second dequantizing unit 254 also dequantizes quantized data in the second encoded signal to produce spectral data, associates this spectral data with the specified ten sample, and outputs it to the integrating unit 255.

The number of samples of spectral data quantized by the second quantizing unit 153 is not limited to ten consisting of two sets of five samples on both sides of spectral data of the highest absolute value. The number of these samples may be lower or higher than five. It is also possible for the second quantizing unit 153 to determine the number of these samples in accordance with the bit amount of an encoded bit stream of each frame. In this case, this number of the samples as well as quantized data of these samples may be included in the second encoded signal.

In the present embodiment, the second quantizing unit 153/156 uses a predetermined scale factor for quantization. However, it is alternatively possible to calculate an appropriate scale factor for each scale factor band and to include each calculated scale factor in the second encoded signal. By calculating a scale factor that generates quantized data whose highest value is "7", for instance, the bit amount of data required for transferring quantized data can be reduced.

In the present embodiment, the second encoded signal only includes either quantized data produced by the second quantizing unit 153/156 or such quantized data and scale factors. The second encoded signal, however, may include other information. That is to say, the encoding device 102 may also generate sub information representing the higher-frequency spectral data, as described in the first embodiment, as well as quantizing the ten samples of spectral data by using a predetermined scale factor to produce quantized data. This quantized data and the sub information are included in the second encoded signal. In this case, the encoding device 102 does not transmit higher-frequency quantized data and its scale factors, and the decoding device 202 reconstructs the higher-frequency spectral data based on the sub information. The sub information for short blocks has been described in FIGS. 10 and 11 and in the end of the first embodiment. The sub information for long blocks can be also produced in the same way as the sub information for short blocks except that the sub information for long blocks corresponds to 512 samples in the higher frequency band, whereas the sub information for short blocks corresponds to 64 samples in the higher frequency band. Samples based on long blocks are placed into scale factor bands based on long blocks. When the sub information is added in this way to the third embodiment, the bit amount of the encoded audio bit stream can be reduced by the bit amount of higher-frequency quantized data and scale factors.

The above sub information has been described as being produced for each scale factor band. It is possible, however, to produce a single set of sub information for two or more scale factor bands. Two sets of sub information may be produced for a single scale factor band.

The sub information of the present embodiment may be encoded for each channel or for two or more channels.

In the above case, it is not necessary to duplicate spectral data in the lower frequency band in accordance with the sub information so as to reconstruct the higher-frequency spectral data. Instead, the higher-frequency spectral data may be produced from the second encoded signal alone.

The encoding device 102 and the decoding device 202 of the present embodiment can be realized simply by adding the second quantizing unit 153/156 and the second encoding unit 154 to the conventional encoding device and by adding the second decoding unit 253 and the second dequantizing unit 254 to the conventional decoding device. The encoding device 102 and the decoding device 202 can be thus achieved without extensively changing constructions of the conventional encoding and decoding devices.

The third embodiment has been described by using the conventional MPEG-2 AAC as one example, although other audio encoding method, including a newly developed encoding method, may be alternatively used for the present invention.

The second encoded signal for the third embodiment may be attached to the end of the first encoded signal as shown in FIG. 5B of the first embodiment, or may be attached to the end of the header information as shown in FIG. 5C. Note, however, that the first encoded signal of the present embodiment is based on long blocks and therefore the first encoded signal for a frame corresponds to an audio signal composed of 1,024 samples. When the conventional decoding device 400 receives the second encoded signal included in the encoded audio bit stream in this way, the decoding device 400 can reproduce the encoded audio bit stream without errors. The second encoded signal may be inserted into the first encoded signal, or the header information. Regions, into which the second encoded signal is inserted, of the encoded bit stream may not be consecutively arranged and may be scattered as shown in FIG. 6C, where the second encoded signal is inserted into non-consecutive regions within the header information and the first encoded signal. It is alternatively possible to include the second encoded signal and the first encoded signal into separate bit streams as shown in FIGS. 6A and 6B. This makes it possible to transmit or accumulate basic part of the audio signal in advance and later transmit information on the audio signal in the higher frequency band as necessary.

The third embodiment has described the encoding device 102 as including two quantizing units and two encoding units. The encoding device 102, however, may include three or more quantizing units and encoding units.

Similarly, the decoding device 202 may include three or more dequantizing units and decoding units, although the third embodiment describes the decoding device 202 as including two dequantizing units and two decoding units.

Operations described for the present invention may be embodied by not only hardware but also software. Some part of the operations may be embodied by hardware and remaining part may be embodied by software.

The encoding device 100, 101, or 102 of the present invention may be installed in a broadcast station within a content distribution system and may transmit the encoded audio bit stream of the present invention to a receiving device, which includes the decoding device 200, 201, or 202, of the content distribution system.

INDUSTRIAL APPLICABILITY

The encoding device of the present invention is useful as an audio encoding device used in a broadcast station for a satellite broadcast, including BS (broadcast satellite) and CS (communication satellite) broadcasts, or as an audio encoding device used for a content distributing server that distributes contents via a communication network such as the Internet. The present encoding device is also useful as a program executed by a general-purpose computer to perform audio signal encoding.

The decoding device present invention is useful not only as an audio decoding device provided in an STB for home use, but also as a program executed by a general-purpose computer to perform audio signal decoding, a circuit board and an LSI provided in an STB or a general-purpose computer, and an IC card inserted into an STB or a general-purpose computer.

The invention claimed is:

1. An encoding device for receiving and encoding an audio signal, the encoding device comprising:

a transforming unit operable to extract a part of the audio signal at predetermined time intervals and to transform each extracted part to produce a plurality of window spectrums in each frame cycle, wherein the produced window spectrums are composed of short blocks and show how a frequency spectrum changes over time;

a judging unit operable to:

(a) judge whether there is a similarity of a predetermined degree among the produced window spectrums by comparing the produced window spectrums with one another; and (b) when there is the similarity between a first window spectrum of the produced window spectrums and a second window spectrum of the produced window spectrums, (1) specify, for each frequency, an average of high frequency parts of the first and second window spectrums so as to produce a new high frequency part composed of a plurality of specified averages, (2) replace the high frequency part of the second window spectrum with the new high frequency part, and (3) replace the high frequency part of the first window spectrum with a predetermined value, wherein the first window spectrum and the second window spectrum share the new high frequency part of the second window spectrum;

a first quantizing unit operable to quantize each of the plurality of window spectrums to produce a plurality of quantized window spectrums after operation of the judging unit;

a first encoding unit operable to encode the quantized window spectrums to produce first encoded data; and an output unit operable to output the produced first encoded data.

2. The encoding device of claim 1 wherein the judging unit is also operable to generate sharing information showing, for each of the plurality of window spectrums, a result of the judgment and the encoding device further comprises a second encoding unit operable to encode the generated sharing information to produce second encoded data, wherein the output unit is also operable to output the second encoded data.

3. The encoding device of claim 1, wherein the judging unit is operable to specify a location of a peak of each of the plurality of window spectrums on a frequency axis, compare specified locations of the window spectrums with one another, and make the judgment in accordance with the comparison.

4. The encoding device of claim 1, wherein the judging unit is operable to transform the plurality of window spectrums by using a predetermined function, compare the transformed window spectrums with one another, and make the judgment in accordance with the comparison.

5. The encoding device of claim 2, wherein the output unit is operable to (a) transform the first encoded data into an encoded audio stream that has a predetermined format, (b) place the second encoded data into a region, for which unrestricted use is permitted in the predetermined format, of the encoded audio stream, and (c) output the encoded audio stream.

6. The encoding device of claim 5, wherein the second encoding unit is also operable to add identifying information to the second encoded data, the identifying information showing that the second encoded data is produced by the second encoding unit, wherein the output unit is operable to place the second encoded data, to which the identifying information has been added, into the region of the encoded audio stream.

7. The encoding device of claim 2, wherein the output unit is operable to (a) transform the first encoded data into an encoded audio stream that has a predetermined format, (b) place the second encoded data into a second stream that is different from the encoded audio stream including the first encoded data, and (c) output the second stream and the encoded audio stream.

8. An encoding device for receiving and encoding an audio signal, the encoding device comprising:

a transforming unit operable to extract a part of the audio signal at predetermined time intervals and to transform each extracted part to produce a plurality of window spectrums in each frame cycle, wherein the produced window spectrums are composed of short blocks and show how a frequency spectrum changes over time;

a judging unit operable to:

(a) specify an energy difference between the produced window spectrums obtained by the transforming unit, (b) judge whether there is a similarity, which satisfies a predetermined judgment standard, between the produced window spectrums when the specified energy difference is smaller than a predetermined threshold;

(c) generate sharing information showing, for each of the plurality of window spectrums, a result of the judgment; and (d) when there is the similarity between the first window spectrum of the produced window spectrums and a second window spectrum of the produced window spectrums, (1) replace a high frequency part of the first window spectrum with a predetermined value, wherein the first window spectrum and the second window spectrum share a high frequency part of the second window spectrum;

a first quantizing unit operable to quantize each of the plurality of window spectrums to produce a plurality of quantized window spectrums after operation of the judging unit;

a first encoding unit operable to encode the quantized window spectrums to produce first encoded data; and a second encoding unit operable to encode the generated sharing information to produce second encoded data;

an output unit operable to output the produced first encoded data and the produced second encoded data.

9. The encoding device of claim 8, wherein the judging unit is also operable to generate sub information that shows a characteristic of the high frequency part of the second window spectrum, the second encoding unit is operable to encode the generated sub information and the sharing information to produce the second encoded data, and the judging unit is further operable to replace the high frequency part of the second window spectrum with a predetermined value.

10. The encoding device of claim 9, wherein each of the plurality of window spectrums is divided into a plurality of frequency bands, and the judging unit is operable to calculate a normalizing factor for each frequency band of the high frequency part of the second window spectrum and use each calculated normalizing factor as the sub information, wherein each calculated normalizing factor is used for quantizing a peak value in each frequency band so as to produce a quantized value that is the same in all the frequency bands of the high frequency part.

11. The encoding device of claim 9, wherein each of the plurality of window spectrums is divided into a plurality of frequency bands, and the judging unit is operable to quantize a peak value in each frequency band in the high frequency part of the second window spectrum by using a normalizing factor common to all the frequency bands, and use the quantization result as the sub information.

12. The encoding device of claim 9, wherein each of the plurality of window spectrums is divided into a plurality of frequency bands, and the judging unit is operable to specify a location on a frequency axis where a peak value in each frequency band of the high frequency part of the second window spectrum exists, and use each specified location as the sub information.

13. The encoding device of claim 9, wherein each of the plurality of window spectrums is a Modified Discrete Cosine Transform (MDCT) coefficient and is divided into a plurality of frequency bands, and the judging unit is operable to specify a plus/minus sign of a value that exists in a predetermined location on a frequency axis in the high frequency part of the second window spectrum, and use the specified plus/minus sign as the sub information.

14. The encoding device of claim 9, wherein each of the plurality of window spectrums is divided into a plurality of frequency bands, and the judging unit is operable to (a) generate, for a spectrum in each frequency band of the high frequency part, information that specifies a spectrum in a low frequency part of the second window spectrum, wherein each specified spectrum is the most similar to a spectrum in a frequency band of the high frequency part of the second window spectrum, and (b) use the generated information as the sub information.

15. The encoding device of claim 14, wherein the information generated by the judging unit is shown as a number that identifies the specified spectrum.

16. An encoding device for receiving and encoding an audio signal, the encoding device comprising:

a transforming unit operable to extract a part of the audio signal at predetermined time intervals and to transform each extracted part to produce a plurality of window spectrums in each frame cycle, wherein the produced window spectrums are composed of short blocks and show how a frequency spectrum changes over time;

a judging unit operable to:

(a) judge whether there is a similarity of a predetermined degree among the produced window spectrums by comparing the produced window spectrums with one another; and (b) when there is the similarity between a first window spectrum of the produced window spectrums and a second window spectrum of the produced window spectrums, replace a high frequency part and a low frequency part of the first window spectrum with a predetermined value, wherein the first window spectrum and the second window spectrum share a high frequency part and a low frequency part of the second window spectrum;

a first quantizing unit operable to quantize each of the plurality of window spectrums to produce a plurality of quantized window spectrums after operation of the judging unit;

a first encoding unit operable to encode the quantized window spectrums to produce first encoded data; and an output unit operable to output the produced first encoded data.

17. An encoding device for receiving and encoding an audio signal, the encoding device comprising:

a transforming unit operable to extract a part of the audio signal at predetermined time intervals and to transform each extracted part to produce a plurality of window spectrums in each frame cycle, wherein the produced window spectrums are composed of short blocks and show how a frequency spectrum changes over time;

a judging unit operable to:

(a) judge whether there is a similarity of a predetermined degree among the produced window spectrums by comparing the produced window spectrums with one another;

(b) when there is the similarity between a first window spectrum of the produced window spectrums and a second window spectrum of the produced window spectrums, (1) replace a high frequency part of the first window spectrum with a predetermined value, wherein the first window spectrum and the second window spectrum share a high frequency part of the second window spectrum;

a first quantizing unit operable to quantize each of the plurality of window spectrums to produce a plurality of quantized window spectrums after operation of the judging unit;

a first encoding unit operable to encode the quantized window spectrums to produce first encoded data;

a second quantizing unit operable to quantize, with a predetermined normalizing factor, certain sets of data near a peak in each window spectrum inputted to the first quantizing unit, wherein before quantization by the second quantizing unit, the first quantizing unit is operable to quantize the certain sets of data to produce sets of quantized data that have a predetermined value;

a second encoding unit operable to encode the sets of data quantized by the second quantizing unit so as to produce second encoded data; and an output unit operable to output the produced first encoded data and the produced second encoded data.

18. The encoding device of claim 17, wherein after producing the sets of quantized data, the second quantizing unit is operable to transform the sets of quantized data by using a predetermined function so that the sets of quantized data have a reduced bit amount after being encoded.

19. The encoding device of claim 18, wherein each of the plurality of window spectrums is divided into a plurality of frequency bands, the first quantizing unit is operable to perform quantization for each frequency band, and the second quantizing unit is operable to not quantize a peak in each frequency band and make a predetermined value represent the peak.

20. The encoding device of claim 19, wherein the second quantizing unit is operable to specify the normalizing factor to produce sets of quantized data that have a predetermined bit amount, and quantize the certain sets of data by using the specified normalizing factor to produce the sets of quantized data of the predetermined bit amount, and output the sets of quantized data and the specified normalizing factor.

21. A decoding device for receiving and decoding encoded data that represents an audio signal, the encoded data including first encoded data in a first region and including, in a second region, (a) encoded sharing information relating to a first window spectrum and a second window spectrum and (b) encoded sub information that shows a characteristic of a high frequency part of the second window spectrum, the decoding device comprising:

a first decoding unit operable to decode the first encoded data in the first region to produce first decoded data;

a second decoding unit operable to decode the encoded sharing information to obtain decoded sharing information and the encoded sub information to obtain decoded sub information;

a first dequantizing unit operable to dequantize the first decoded data to produce a plurality of window spectrums in each frame cycle, wherein the produced window spectrums are composed of short blocks and show how a frequency spectrum changes over time;

a second dequantizing unit operable to (a) monitor the produced window spectrums so as to find a first window spectrum included in the produced window spectrums having a high frequency part composed of predetermined values, (b) judge that the high frequency part of the first window spectrum is to be recreated from a high frequency part of a second window spectrum included in the produced window spectrums, (c) generate the high frequency part of the second window spectrum in accordance with the decoded sub information and sharing information, (d) duplicate the generated high frequency part, (e) associate the duplicated high frequency part with the first window spectrum, and (f) output the duplicated high frequency part;

an integrating unit operable to obtain the duplicated high frequency part from the second dequantizing unit and the first window spectrum from the first dequantizing unit, and replace the high frequency part of the first window spectrum with the duplicated high frequency part;

an inverse-transforming unit operable to transform the first window spectrum containing the replaced high frequency part into an audio signal in a time domain; and an audio signal output unit operable to output the audio signal.

22. The decoding device of claim 21, wherein each of the plurality of window spectrums is divided into a plurality of frequency bands, the sub information is a normalizing factor for each frequency band of the high frequency part of the second window spectrum, wherein each normalizing factor is used for quantizing a peak value in each frequency band of the high frequency part so as to produce a quantized value that is the same in all the frequency bands of the high frequency part, and the second dequantizing unit is operable to dequantize the quantized value in each frequency band by using each normalizing factor shown in the decoded sub information so as to obtain each peak value, and generate the high frequency part, which includes each obtained peak value as a peak in each frequency band, of the second window spectrum.

23. The decoding device of claim 21, wherein each of the plurality of window spectrums is divided into a plurality of frequency bands, the sub information is a quantized peak value in each frequency band within the high frequency part of the second window spectrum, each quantized peak value being quantized using a single normalizing factor common to all the frequency bands in the high frequency part, the second dequantizing unit is operable to dequantize each quantized peak value shown as the sub information by using the single normalizing factor to obtain each peak value, and generate the high frequency part, which includes each obtained peak value as a peak in each frequency band, of the second window spectrum.

24. The decoding device of claim 21, wherein each of the plurality of window spectrums is divided into a plurality of frequency bands, the sub information shows a location on a frequency axis where a peak value in each frequency band of the high frequency part of the second window spectrum exists, and the second dequantizing unit is operable to generate the high frequency part in which a peak value in each frequency band is present in a location shown in the sub information.

25. The decoding device of claim 21, wherein each of the plurality of window spectrums is a Modified Discrete Cosine Transform (MDCT) coefficient and is divided into a plurality of frequency bands, the sub information is a plus/minus sign of a value that exists in a predetermined location on a frequency axis in the high frequency part of the second window spectrum, and the second dequantizing unit is operable to generate the high frequency part that includes, in the predetermined location, the value with the plus/minus sign shown in the decoded sub information.

26. The decoding device of claim 21, wherein each of the plurality of window spectrums is divided into a plurality of frequency bands, the sub information specifies, for a spectrum in each frequency band of the high frequency part of the second window spectrum, a spectrum in a low frequency part of the second window spectrum, wherein each specified spectrum is the most similar to a spectrum in a frequency band of the high frequency part of the second window spectrum, and the second dequantizing unit is operable to (a) find each spectrum specified by the sub information from spectrums in the low frequency part produced by the first dequantizing unit, (b) duplicate each found spectrum to produce a plurality of duplicated spectrums, and (c) generate the high frequency part, which is composed of the produced duplicated spectrums, of the second window spectrum.

27. A decoding device for receiving and decoding encoded data that represents an audio signal, the encoded data including first encoded data in a first region and including, in a second region, encoded sharing information related to a first window spectrum and a second window spectrum, the decoding device comprising:

a first decoding unit operable to decode the first encoded data in the first region to produce first decoded data;

a second decoding unit operable to decode the encoded sharing information to obtain decoded sharing information;

a first dequantizing unit operable to dequantize the first decoded data to produce a plurality of window spectrums in each frame cycle, wherein the produced window spectrums are composed of short blocks and show how a frequency spectrum changes over time;

a second dequantizing unit operable to (a) monitor the produced window spectrums so as to find a first window spectrum included in the produced window spectrums having a high frequency part composed of predetermined values, (b) judge that the high frequency part of the first window spectrum is to be recreated from a high frequency part of a second window spectrum included in the produced window spectrums, (c)

obtain the high frequency part of the second window spectrum from the first dequantizing unit based on the sharing information, (d) duplicate the obtained high frequency part, (e) associate the duplicated high frequency part with the first window spectrum, and (f) output the duplicated high frequency part;

an integrating unit operable to obtain the duplicated high frequency part from the second dequantizing unit and the first window spectrum from the first dequantizing unit, and replace the high frequency part of the first window spectrum with the duplicated high frequency part;

an inverse-transforming unit operable to transform the first window spectrum containing the replaced high frequency part into an audio signal in a time domain; and an audio signal output unit operable to output the audio signal, wherein the encoded data received by the decoding device is an encoded audio stream that has a predetermined format, the second region is a region for which unrestricted use is permitted in the predetermined format, and the second decoding unit is operable to analyze data that includes the encoded sharing information, and only decode the encoded sharing information even when the analyzed data includes identifying information that identifies the encoded sharing information.

28. A decoding device for receiving and decoding encoded data that represents an audio signal, the encoded data including first encoded data in a first region and including, in a second region, encoded sharing information related to a first window spectrum and a second window spectrum, the decoding device comprising:

a first decoding unit operable to decode the first encoded data in the first region to produce first decoded data;

a second decoding unit operable to decode the encoded sharing information to obtain decoded sharing information;

a first dequantizing unit operable to dequantize the first decoded data to produce a plurality of window spectrums in each frame cycle, wherein the produced window spectrums are composed of short blocks and show how a frequency spectrum changes over time;

a second dequantizing unit operable to (a) monitor the produced window spectrums so as to find a first window spectrum included in the produced window spectrums having predetermined values, (b) judge that the first window spectrum is to be recreated from a second window spectrum included in the produced window spectrums, (c) obtain the second window spectrum from the first dequantizing unit based on the decoded sharing information, (d) duplicate the second window spectrum, (e) associate the duplicated second window spectrum with the first window spectrum, and (f) output the duplicated second window spectrum;

an integrating unit operable to obtain the duplicated second window spectrum from the second dequantizing unit and the first window spectrum from the first dequantizing unit, and replace the first window spectrum with the duplicated second window spectrum;

an inverse-transforming unit operable to transform the replaced first window spectrum into an audio signal in a time domain; and an audio signal output unit operable to output the audio signal.

29. A decoding device for receiving and decoding encoded data that represents an audio signal, the encoded data including first encoded data in a first region, the decoding device comprising:

a first decoding unit operable to decode the first encoded data in the first region to produce first decoded data;

a first dequantizing unit operable to dequantize the first decoded data to produce a plurality of window spectrums in each frame cycle, wherein the produced window spectrums are composed of short blocks and show how a frequency spectrum changes over time;

a second dequantizing unit operable to (a) monitor the produced window spectrums so as to find a first window spectrum included in the produced window spectrums having a high frequency part composed of predetermined values, (b) judge that the high frequency part of the first window spectrum is to be recreated from a high frequency part of a second window spectrum included in the produced window spectrums, (c) obtain the high frequency part of the second window spectrum from the first dequantizing unit based on the judgment, (d) duplicate the obtained high frequency part, (e) associate the duplicated high frequency part with the first window spectrum, and (f) output the duplicated high frequency part;

an integrating unit operable to obtain the duplicated high frequency part from the second dequantizing unit and the first window spectrum from the first dequantizing unit, and replace the high frequency part of the first window spectrum with the duplicated high frequency part;

an inverse-transforming unit operable to transform the first window spectrum containing the replaced high frequency part into an audio signal in a time domain; and an audio signal output unit operable to output the audio signal, wherein with a predetermined coefficient, the second dequantizing unit is operable to amplify an amplitude of the duplicated high frequency part of the second window spectrum, associate the duplicated high frequency part that has the amplified amplitude with the first window spectrum, and output the duplicated high frequency part.

30. A decoding device for receiving and decoding encoded data that represents an audio signal, the encoded data including first encoded data in a first region, the decoding device comprising:

a first decoding unit operable to decode the first encoded data in the first region to produce first decoded data;

a first dequantizing unit operable to dequantize the first decoded data to produce a plurality of window spectrums in each frame cycle, wherein the produced window spectrums are composed of short blocks and show how a frequency spectrum changes over time;

a second dequantizing unit operable to (a) monitor the produced window spectrums so as to find a first window spectrum included in the produced window spectrums having a high frequency part composed of predetermined values, (b) judge that the high frequency part of the first window spectrum is to be recreated from a high frequency part of a second window spectrum included in the produced window spectrums, (c) obtain the high frequency part of the second window spectrum from the first dequantizing unit based on the judgment, (d) duplicate the obtained high frequency part, (e) associate the duplicated high frequency part with the first window spectrum, and (f) output the duplicated high frequency part;

an integrating unit operable to obtain the duplicated high frequency part from the second dequantizing unit and the first window spectrum from the first dequantizing unit, and replace the high frequency part of the first window spectrum with the duplicated high frequency part;

an inverse-transforming unit operable to transform the first window spectrum containing the replaced high frequency part into an audio signal in a time domain; and an audio signal output unit operable to output the audio signal, wherein when finding a window spectrum composed of sets of data, all of which have a predetermined value, the second dequantizing unit is operable to (a) judge that the high frequency part of the found window spectrum is to be recreated from the high frequency part of the second window spectrum, (b)

obtain the whole second window spectrum, including both high and low frequency parts, from the first dequantizing unit, (c) duplicate the obtained second window spectrum, (d) associate the duplicated second window spectrum with the found window spectrum, and (e) output the duplicated second window spectrum, and the integrating unit is operable to replace the entire found window spectrum with the duplicated second window spectrum, the inverse-transforming unit is operable to transform the replaced window spectrum into an audio signal in the time domain, and the audio signal output unit is operable to output the audio signal.

31. A decoding device for receiving and decoding encoded data that represents an audio signal, the encoded data including first encoded data in a first region and second encoded data, which has been produced by quantizing a part of a window spectrum with a predetermined normalizing factor that is different from a normalizing factor used for quantizing the same window spectrum in the first encoded data, in a second region, the decoding device comprising:

a first decoding unit operable to decode the first encoded data in the first region to produce first decoded data;

a second decoding unit operable to decode the second encoded data to obtain second decoded data;

a first dequantizing unit operable to dequantize the first decoded data to produce a plurality of window spectrums in each frame cycle, wherein the produced window spectrums are composed of short blocks and show how a frequency spectrum changes over time;

a second dequantizing unit operable to (a) monitor the produced window spectrums so as to find a part of a window spectrum which includes consecutive predetermined values, (b) specify a part included in the second decoded data that corresponds to the found part, and (c) dequantize the specified part by using the predetermined normalizing factor to obtain a dequantized part composed of a plurality of sets of data;

an integrating unit operable to replace the part found by the second dequantizing unit with the plurality of sets of data;

an inverse-transforming unit operable to transform the window spectrum containing the plurality of sets of data into an audio signal in a time domain; and an audio signal output unit operable to output the audio signal.

32. The decoding device of claim 31, wherein the second dequantizing unit is operable to transform the specified part of the second decoded data by using a predetermined function, and then dequantize the transformed part to obtain the dequantized part.

33. The decoding device of claim 32, wherein from the second decoded data, the second dequantizing unit is operable to (a) extract the predetermined normalizing factor and the specified part quantized by the predetermined normalizing factor, (b) transform the extracted part by using the predetermined function to produce the transformed part, and (c) dequantize the transformed part by using the extracted normalizing factor to obtain the dequantized part.

* * * * *